US009573791B2

(12) United States Patent
Garcia

(10) Patent No.: US 9,573,791 B2
(45) Date of Patent: Feb. 21, 2017

(54) ELEVATORS AND ELEVATOR ARRANGEMENTS WITH MAINTENANCE CABINET IN LANDING WALL

(71) Applicant: Edy Christian Encinas Garcia, Matamoros Coahuila (MX)

(72) Inventor: Edy Christian Encinas Garcia, Matamoros Coahuila (MX)

(73) Assignee: Kone Corporation, Helsinki (FI)

( * ) Notice: Subject to any disclaimer, the term of this patent is extended or adjusted under 35 U.S.C. 154(b) by 320 days.

(21) Appl. No.: 13/766,291

(22) Filed: Feb. 13, 2013

(65) Prior Publication Data

US 2014/0224591 A1 Aug. 14, 2014

(51) Int. Cl.

| | |
|---|---|
| ***B66B 11/00*** | (2006.01) |
| ***B66B 1/34*** | (2006.01) |
| ***B66B 13/30*** | (2006.01) |

(52) U.S. Cl.

CPC ..... *B66B 11/0005* (2013.01); *B66B 1/3415* (2013.01); *B66B 11/001* (2013.01); *B66B 13/306* (2013.01)

(58) Field of Classification Search

CPC .... B66B 5/0025; B66B 5/0031; B66B 5/0043; B66B 11/001; B66B 11/002; B66B 11/0246; B66B 13/14; B66B 13/30; B66B 13/306; B66B 1/466; B66B 11/0015

IPC ..... B66B 1/34

See application file for complete search history.

(56) References Cited

U.S. PATENT DOCUMENTS

| | | | | |
|---|---|---|---|---|
| 5,740,888 | A | 4/1998 | Aulanko et al. | |
| 5,971,109 | A * | 10/1999 | Aulanko et al. | 187/263 |
| 6,196,355 | B1 * | 3/2001 | Fargo et al. | 187/393 |
| 6,230,845 | B1 * | 5/2001 | Yamakawa et al. | 187/391 |
| 6,336,523 | B1 * | 1/2002 | Ozeki et al. | 187/391 |
| 6,378,660 | B1 * | 4/2002 | Adifon | B66B 9/04 187/272 |
| 6,405,834 | B1 | 6/2002 | Chida et al. | |
| 6,484,850 | B1 | 11/2002 | Kobayashi et al. | |
| 6,896,105 | B1 | 5/2005 | Yamakawa | |
| 7,398,861 | B2 * | 7/2008 | Rossignol et al. | 187/314 |
| 2012/0304550 | A1 * | 12/2012 | Teixeira Pinto Dias | 52/30 |
| 2012/0305337 | A1 * | 12/2012 | Hopp et al. | 187/336 |

FOREIGN PATENT DOCUMENTS

CN 101683943 A 3/2010

OTHER PUBLICATIONS

CN101683943 English Translation.pdf.*

* cited by examiner

*Primary Examiner* — Minh Truong

(74) *Attorney, Agent, or Firm* — Harness, Dickey & Pierce

(57) ABSTRACT

An elevator arrangement for an elevator includes a hoisting machine and a maintenance panel. The hoisting machine is arranged in an elevator hoistway, and configured to move an elevator car within the elevator hoistway via a hoisting rope arrangement. The maintenance panel includes components for at least one of control and service of at least one operation of the elevator arrangement. The maintenance panel is configured to slide out from a landing wall into a landing doorway of the elevator arrangement.

18 Claims, 21 Drawing Sheets

Electric Brake Release (EBR)

Manual Brake Release

ELEVATORS AND ELEVATOR ARRANGEMENTS WITH MAINTENANCE CABINET IN LANDING WALL

BACKGROUND

In conventional European configurations for machine room less (MRL) elevators, all controller components (e.g., central processing unit (CPU), advance door opening board (ADON), optional boards (OPTs), rectifier boards (REC), drive, transformers, etc.) are inside the elevator hoistway. A maintenance access panel (MAP) including extra devices is used to communicate with the controller components inside the elevator hoistway. When the elevator is in operation, only the MAP, not the controller components inside the elevator hoistway, are accessible by a maintenance technician. Unfortunately, national safety codes for elevators in North America do not permit use of these conventional European configurations.

SUMMARY

At least some example embodiments provide elevators, elevator arrangements and elevator systems having a maintenance cabinet in a landing wall of the elevator hoistway. The maintenance cabinet includes low voltage electrical components capable of being serviced while the elevator is in operation.

At least one example embodiment provides an elevator arrangement. According to at least this example embodiment, the elevator arrangement includes: a hoisting machine in an elevator hoistway, the hoisting machine being configured to move an elevator car within the elevator hoistway via a hoisting rope arrangement; a first maintenance cabinet within the elevator hoistway, the first maintenance cabinet including components that are serviceable only after the elevator is shutdown; and a second maintenance cabinet in a landing wall of the elevator hoistway, the second maintenance cabinet including a maintenance panel, the maintenance panel being accessible while the elevator is in operation, and including only electrical components serviceable while the elevator is in operation.

At least one other example embodiment provides an elevator arrangement for an elevator. According to at least this example embodiment, the elevator arrangement includes: a hoisting machine in an elevator hoistway, the hoisting machine being configured to move an elevator car within the elevator hoistway via a hoisting rope arrangement; and a maintenance panel, including components for at least one of control and service of at least one operation of the elevator arrangement, the maintenance panel being configured to slide out from a landing wall into a landing doorway of the elevator arrangement.

According to at least some example embodiments, the maintenance panel may be accessible from a landing of the elevator. The maintenance panel may be configured to slide out from the landing wall into a landing doorway of the elevator arrangement.

The elevator arrangement may further include a brake release in the second maintenance cabinet. The brake release may be one of a manual brake release and an electric brake release.

The second maintenance cabinet may be arranged entirely within the landing wall.

According to at least some example embodiments, the first maintenance cabinet may include high voltage components of the elevator. The high voltage components may include an elevator drive system, a rectifier board, emergency brake circuits, an autotransformer, and/or a toroid. The first maintenance cabinet may be fixed in an upper portion of a hoistway wall of the elevator hoistway. The first maintenance cabinet may be fixed at a same side as the hoisting machine within the elevator hoistway.

According to at least some example embodiments, the elevator arrangement may further include a maintenance panel door enclosing the maintenance panel within the second maintenance cabinet.

According to at least some example embodiments, the second maintenance cabinet may include: a plurality of maintenance panels; a first cabinet including a first of the plurality of maintenance panels; and a second cabinet including a second of the plurality of maintenance panels, and being configured to be accessed independently from the first cabinet. The second cabinet may be arranged above the first cabinet. The second of the plurality of maintenance panels may include at least one disconnect switch. The second of the plurality of maintenance panels may further include at least one extra option board.

The maintenance panel may be configured to slide laterally outward from the second maintenance cabinet and the landing wall so as to be accessible from the elevator landing.

The second maintenance cabinet may further include slide rails mounted inside the second maintenance cabinet. The maintenance panel may be fixed to the slide rails inside the second maintenance cabinet, and the slide rails may be configured such that the maintenance panel slides laterally outward from the landing wall in a plane that is parallel to a plane of the landing wall.

Each of the first and second cabinets may be accessible while the elevator is in service.

The maintenance panel may be configured to be manually slid out from the landing wall using a handle. The second maintenance cabinet may include all electrical elevator components that are serviceable while the elevator is in service.

According to at least some example embodiments, the second maintenance cabinet may include an upper portion and a lower portion. The maintenance panel may be arranged in the lower portion of the second maintenance cabinet, and the upper and lower portions of the second maintenance cabinet may be configured to be accessed independently from one another.

The upper portion of the second maintenance cabinet may include disconnect switches, a display, a brake release, and an LED indicator light. The disconnect switches, the display, the brake release, and the LED indicator light may be immovably fixed in the upper portion of the second maintenance cabinet.

The electrical components serviceable while the elevator is in operation may include at least one of: a switch module bypass, a traction loss switch, a central processing unit (CPU), an advance door opening board (ADON) circuit, a voltage to current (VTC) board, gateway boards, emergency terminal speed limiting (ETSL) boards, input/output boards, and a fuse state identification module.

The maintenance panel may further include at least one of: optional boards, a safety chain module, a battery, and a repeater. Each of the upper portion and lower portion of the second maintenance cabinet may be accessible while the elevator is in service.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected example embodiments and not all possible implementations, and are not intended to limit the scope of the present disclosure.

Corresponding reference numerals indicate corresponding parts throughout the several views of the drawings.

DETAILED DESCRIPTION

Figure 1A:
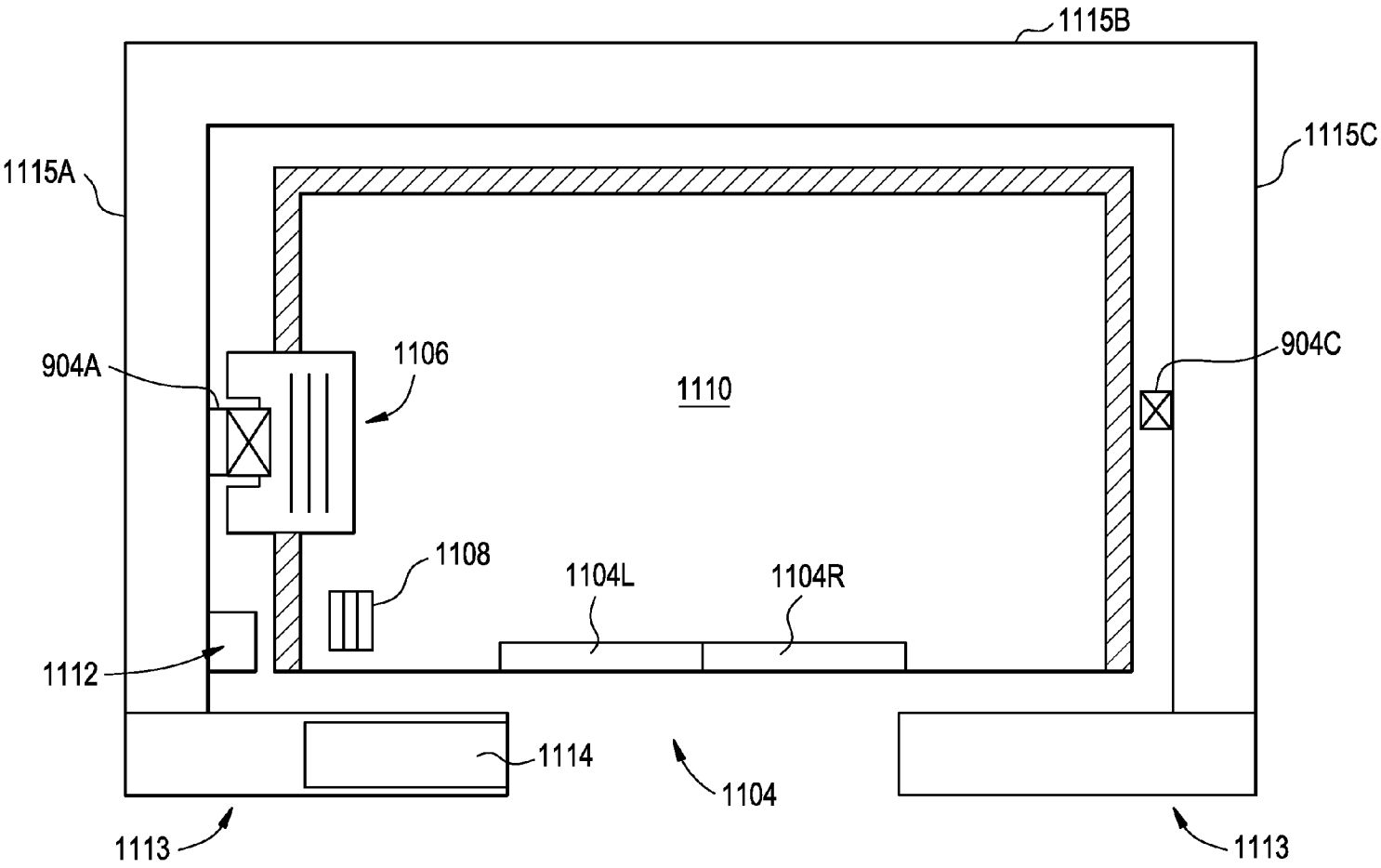
FIG. 1A is a top plan view of an elevator arrangement according to an example embodiment.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Components discussed herein as being fixed, positioned and/or arranged may be fixed in any conventional manner, for example, via bolts, nut and bolt combinations, etc. Alternatively, the components may be removably or detachably fixed. In another example, components may be referred to as immovably fixed. In one example, the position of components in an upper portion of the low voltage maintenance cabinet may be immovably fixed in that the components are not configured to slide in and out of the low voltage maintenance cabinet.

Figure 1B:
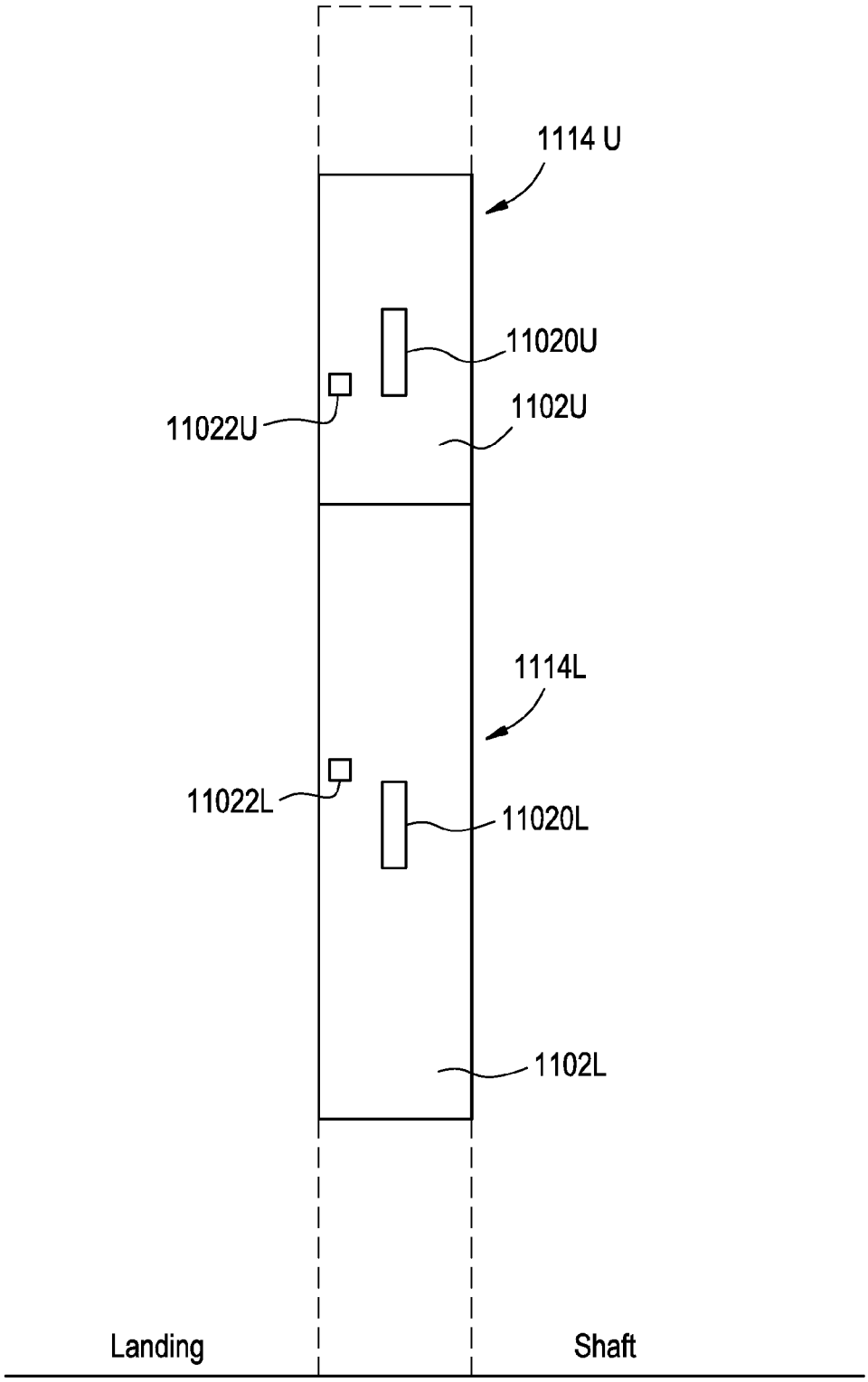
FIG. 1B is a front view of an example embodiment of a low voltage maintenance cabinet when viewed from within the landing doorway in FIG. 1A.

FIG. 1A is a top plan view of an elevator arrangement according to an example embodiment. FIG. 1B is a front view of the low voltage maintenance cabinet 1114 shown in FIG. 1A when viewed from within the landing doorway 1104.

Figure 2A:
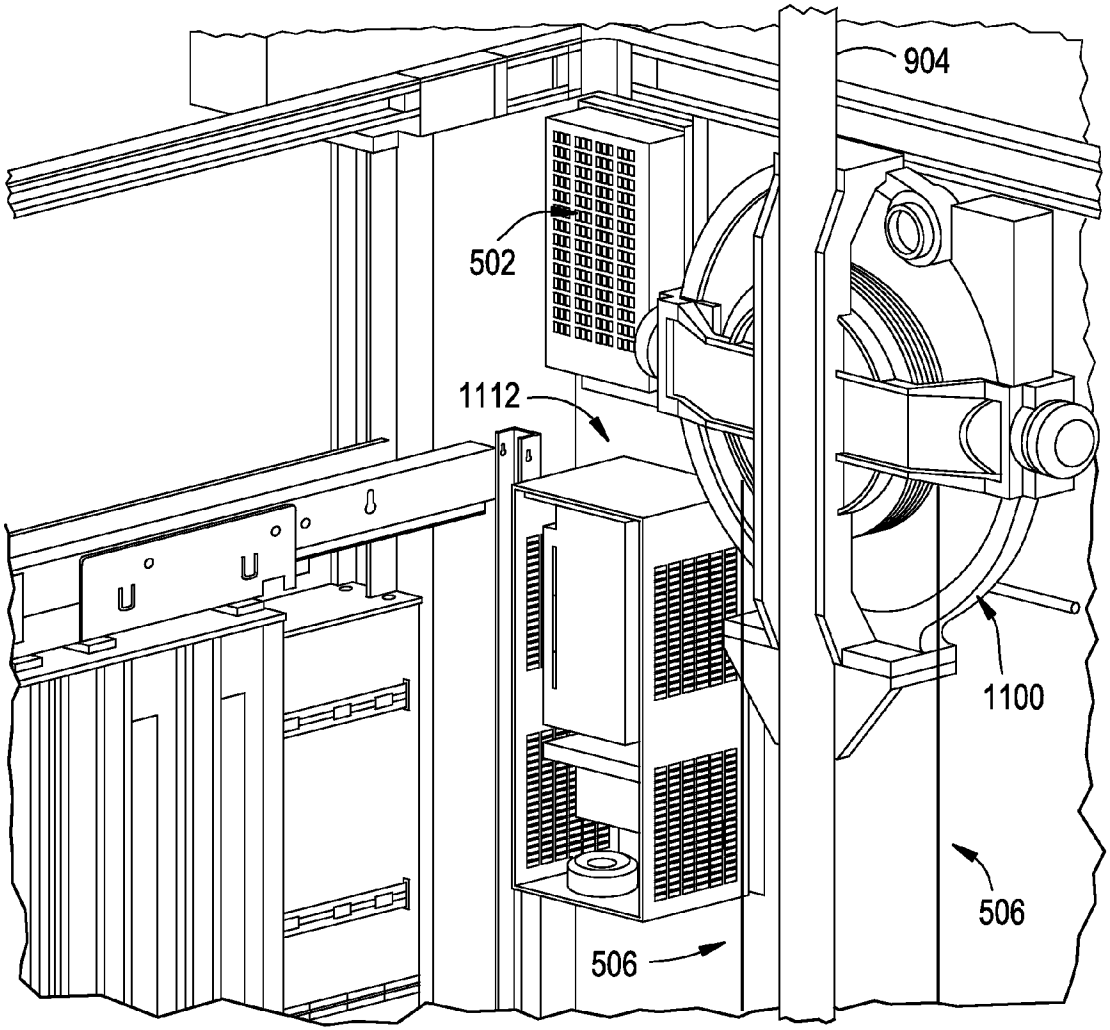
FIG. 2A is a perspective view of the elevator arrangement shown in FIG. 1A taken from inside the elevator hoistway.
Figure 2B:
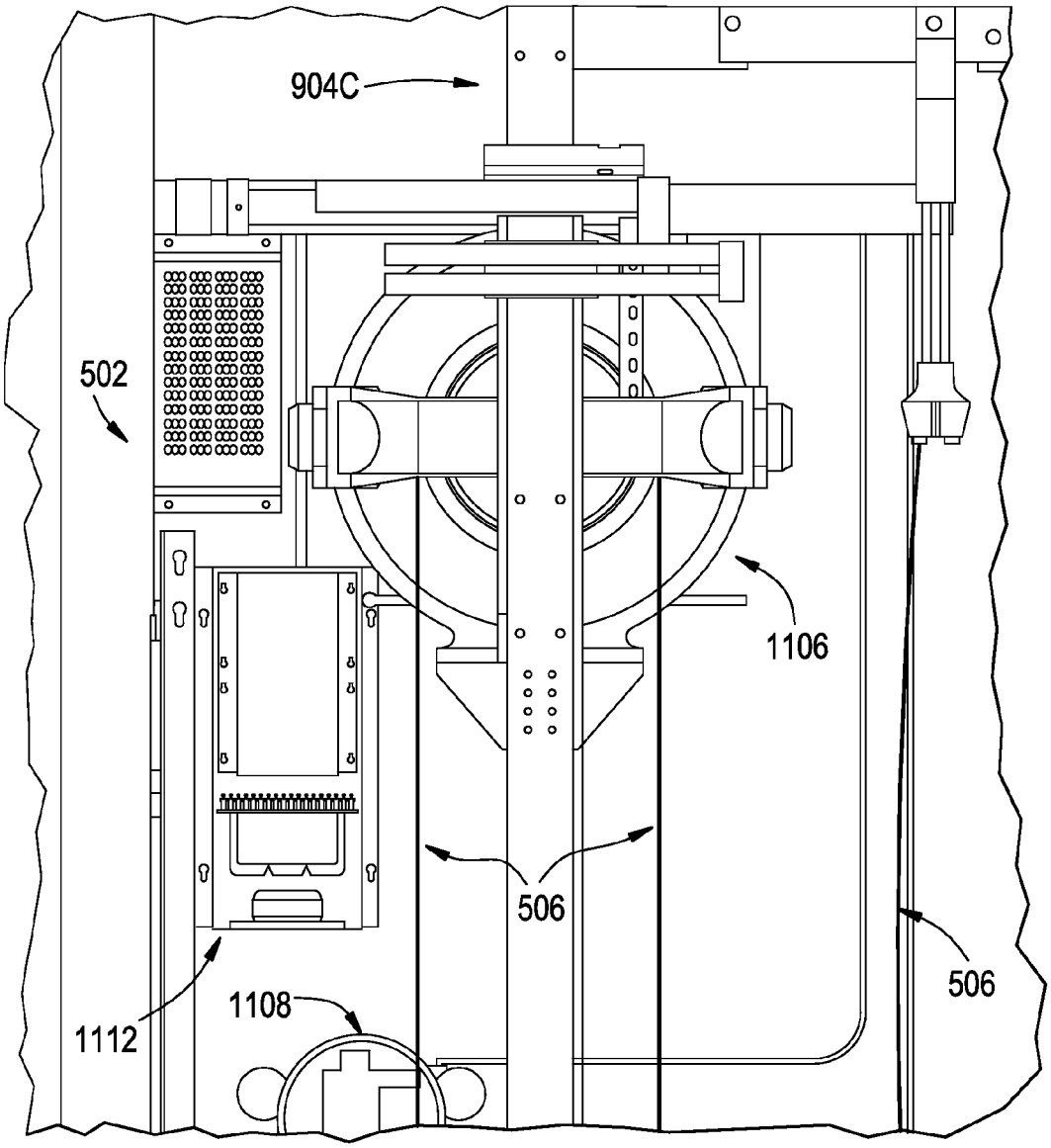
FIG. 2B is a view of the elevator arrangement from a hoistway wall in FIG. 1A.

FIG. 2A is a perspective view of the elevator arrangement shown in FIG. 1A taken from inside the elevator hoistway or shaft. FIG. 2B is a view of the elevator arrangement from the hoistway wall 1115C in FIG. 1A.

Figure 3:
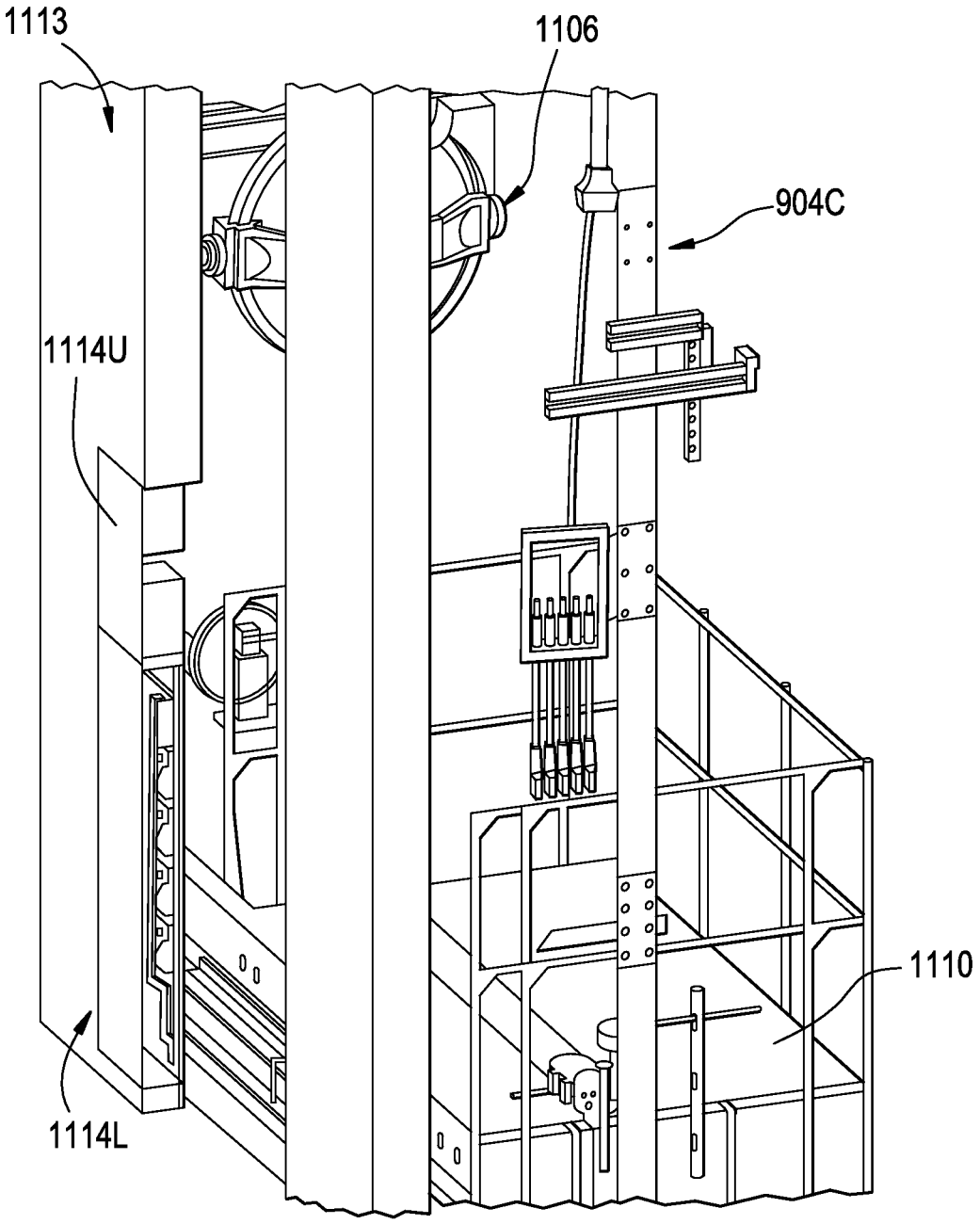
FIG. 3 is another perspective view of the elevator arrangement shown in FIG. 1A.
Figure 4:
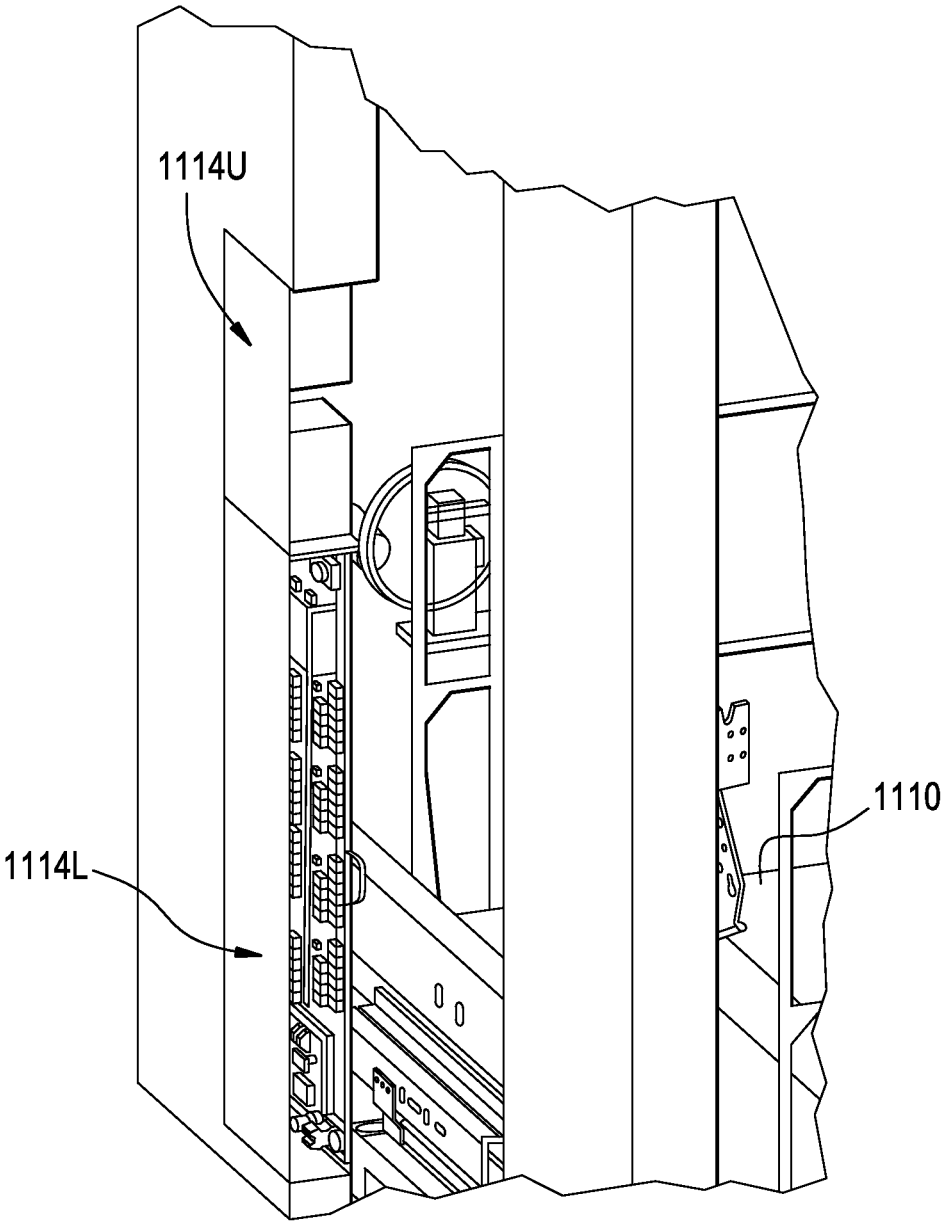
FIG. 4 is a larger perspective view of a portion of the elevator arrangement shown in FIG. 3.

FIG. 3 is another perspective view of the elevator arrangement shown in FIG. 1A. The perspective view shown in FIG. 3 is taken from the landing side of the elevator arrangement. FIG. 4 is a larger perspective view of a portion of the elevator arrangement shown in FIG. 3.

Although example embodiments will be described with regard to the example configuration shown in FIGS. 1A through 4, it should be understood that example embodiments may be implemented in conjunction with other elevator arrangement configurations. Moreover, one can appreciate that all components/elements of the elevator arrangement are not shown in each of FIGS. 1A through 4 for the sake of clarity.

Referring to FIGS. 1A through 4, an elevator car 1110 is positioned within an elevator shaft (also referred to herein as an elevator hoistway). A hoisting or hoist machine (also referred to herein as a hoisting or hoist motor) 1106 and a traction sheave 1108 are also positioned within the elevator shaft. In this example, the hoisting machine 1106 is positioned above the elevator car 1110. The hoisting machine 1106 and the traction sheave 1108 are configured to raise and lower the elevator car 1110 along car guide rails 904A and 904C within the elevator shaft via an arrangement of hoisting ropes 506. Because hoisting rope arrangements for moving elevator cars along car guide rails within an elevator shaft are well-known, a detailed discussion is omitted.

In this example, the car guide rails 904A and 904C are mounted to an interior of respective hoistway walls 1115A and 1115C of the elevator shaft. The hoisting machine 1106 is mounted to the car guide rail 904A. Alternatively, as is known in the art, an elevator car frame (not shown) may be fixed to one or more of the hoistway walls 1115A, 1115B, 1115C to support the car guide rails 904A and 904C as well as the hoisting machine 1106, the traction sheave 1108 and/or the elevator car 1110. In this example, the hoisting machine 1106 and/or the traction sheave 1108 may be fixed to the elevator car frame.

Still referring to FIGS. 1A through 4, a high voltage maintenance cabinet 1112 is also positioned in the elevator shaft. As discussed herein, the high voltage maintenance cabinet 1112 may also be referred to as a first maintenance cabinet.

In at least this example embodiment, the high voltage maintenance cabinet 1112 is mounted to an interior of the hoistway wall 1115A in an upper portion of the elevator shaft. According to at least some other example embodiments, however, the high voltage maintenance cabinet 1112 may be mounted in a lower portion of the elevator shaft. Additionally, according to at least some alternative example embodiments, the high voltage maintenance cabinet 1112 may be fixed or mounted to a car guide rail (e.g., car guide rail 904A or 904C), a portion of the elevator car frame (not shown), or the interior of one of the other hoistway walls 1115B and 1115C.

At positions facing a landing doorway 1104, the elevator car 1110 includes door leaves 1104L and 1104R through which passengers enter and leave the elevator car 1110. The opening and closing of the door leaves 1104L and 1104R is guided by a car sill.

Still referring to FIGS. 1A through 4, a low voltage maintenance cabinet 1114 is arranged within a landing wall 1113 of the elevator shaft. As discussed herein, the low voltage maintenance cabinet 1114 may be referred to as the second maintenance cabinet.

According to at least this example embodiment, the low voltage maintenance cabinet 1114 includes an upper cabinet 1114U (also referred to as an upper compartment or upper cabinet portion) and a lower cabinet or compartment 1114L (also referred to as an lower compartment or lower cabinet portion). As discussed herein, the lower cabinet 1114L may be referred to as the first cabinet, first compartment or first cabinet portion, and the upper cabinet 1114U may be referred to as the second cabinet, second compartment or second cabinet portion.

The low voltage maintenance cabinet 1114 may be mounted to an elevator side of the landing wall 1113. In this example, the elevator side of the landing wall 1113 refers to the interior side of the landing wall 1113 facing the elevator landing. Alternatively, the low voltage maintenance cabinet 1114 may be mounted to a landing side of the landing wall 1113. In this example, the landing side of the landing wall 1113 refers to the interior side of the landing wall 1113 facing the elevator shaft. In yet another alternative, the low voltage maintenance cabinet 1114 may be mounted to both the elevator side and the landing side of the landing wall 1113. In still other alternative example embodiments, the low voltage maintenance cabinet 1114 may be mounted to another portion of the landing wall 1113.

According to at least some example embodiments, the low voltage maintenance cabinet 1114 is enclosed by at least one maintenance cabinet door arranged within the door jamb of the landing doorway 1104.

As shown in FIG. 1B, for example, the upper cabinet 1114U is enclosed by an upper cabinet door 1102U. The upper cabinet door 1102U includes a handle 11020U to open and close the upper cabinet door 1102U. The upper cabinet door 1102U also includes a lock or locking mechanism 11022U to prevent unauthorized access to the upper cabinet 1114U. The lock 11022U may be any suitable lock or locking mechanism accessible with, for example, a key, a code, etc. At least when closed, the upper cabinet door 1102U is perpendicular or substantially perpendicular to the plane of the landing wall 1113 and the plane of the direction of movement of the elevator door leaves 1104L and 1104R.

Similarly, the lower cabinet 1114L is enclosed by a lower cabinet door 1102L. The lower cabinet door 1102L includes a handle 11020L to open and close the lower cabinet door 1102L. The lower cabinet door 1102L also includes a lock or locking mechanism 11022L to prevent unauthorized access to the lower cabinet 1114L. The lock 11022L may be any suitable lock or locking mechanism accessible with, for example, a key, a code, etc. At least when closed, the lower cabinet door 1102L is also perpendicular or substantially perpendicular to the plane of the landing wall 1113 and the plane of the direction of movement of the elevator door leaves 1104L and 1104R.

As discussed herein, the upper cabinet door 1102U and the lower cabinet door 1102L may form an inner or inside portion of the door jamb of the landing doorway 1104 when closed.

As will be discussed in more detail later, one or more maintenance panels may be arranged in the low voltage maintenance cabinet 1114. The one or more maintenance panels are configured to slide in and out of the low voltage maintenance cabinet 1114 such that the one or more maintenance panels are accessible by a maintenance technician from the elevator landing while the elevator system is in operation. According to at least one example embodiment, the maintenance panel includes components for control and/or service of at least one operation of the elevator arrangement. The maintenance panel is configured to slide out from the landing wall into a landing doorway of the elevator arrangement.

In one example, the one or more maintenance panels are configured to slide laterally outward from the low voltage maintenance cabinet 1114 and the landing wall 1113 into the landing doorway 1104 in a plane parallel to the plane of the landing wall 1113. The maintenance technician is able to access the low voltage maintenance cabinet 1114 independent of the location of the elevator car 1110 within the elevator shaft. In this regard, the maintenance technician may access the low voltage maintenance cabinet 1114 even as the elevator car 1110 passes the elevator landing at which the low voltage maintenance cabinet 1114 is located.

Still referring to FIGS. 1A through 4, a resistor box 502 is fixed to the hoistway wall 1115A above the high voltage maintenance cabinet 1112. Alternatively, the resistor box 502 may be fixed to an elevator car frame within the elevator hoistway.

Figure 5B:
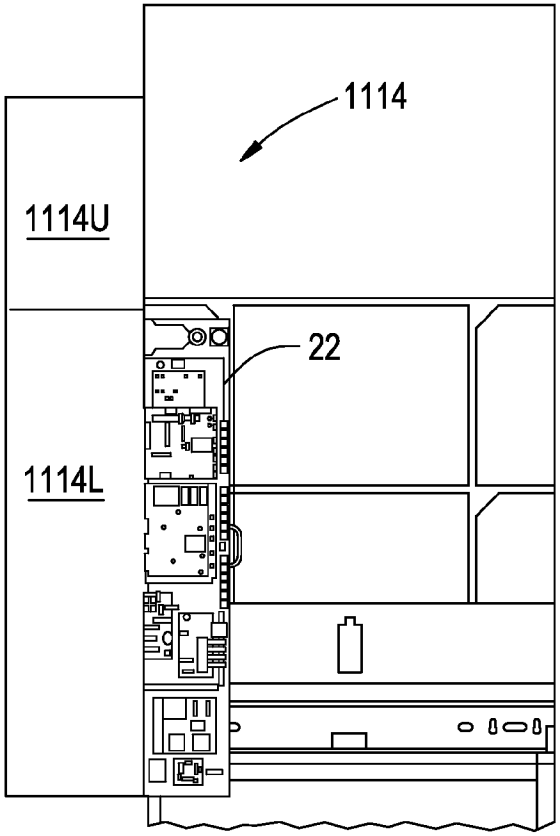
FIG. 5B is another front elevational view taken from the landing side of the elevator arrangement.
Figure 5A:
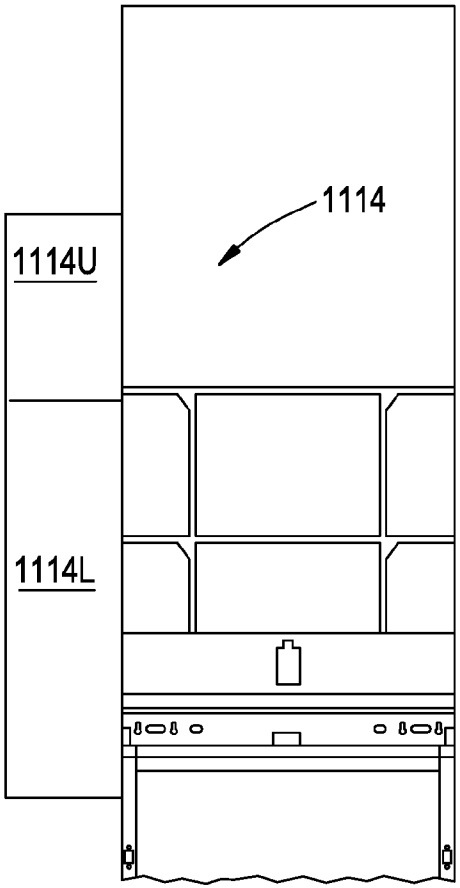
FIG. 5A is a front elevational view taken from the landing side of the elevator arrangement.

FIG. 5A is a front elevational view taken from the landing side of the elevator arrangement described above with regard to FIGS. 1A through 4 when the one or more maintenance panels are enclosed within (or inside) the low voltage maintenance cabinet 1114. This position may be referred to as the closed position.

FIG. 5B is a front elevational view taken from the landing side of the elevator arrangement described above with regard to FIGS. 1A through 4 when a low voltage maintenance panel 22 (described above) is slid out from the lower cabinet 1114L. This position may be referred to as the open or maintenance position.

Figure 6:
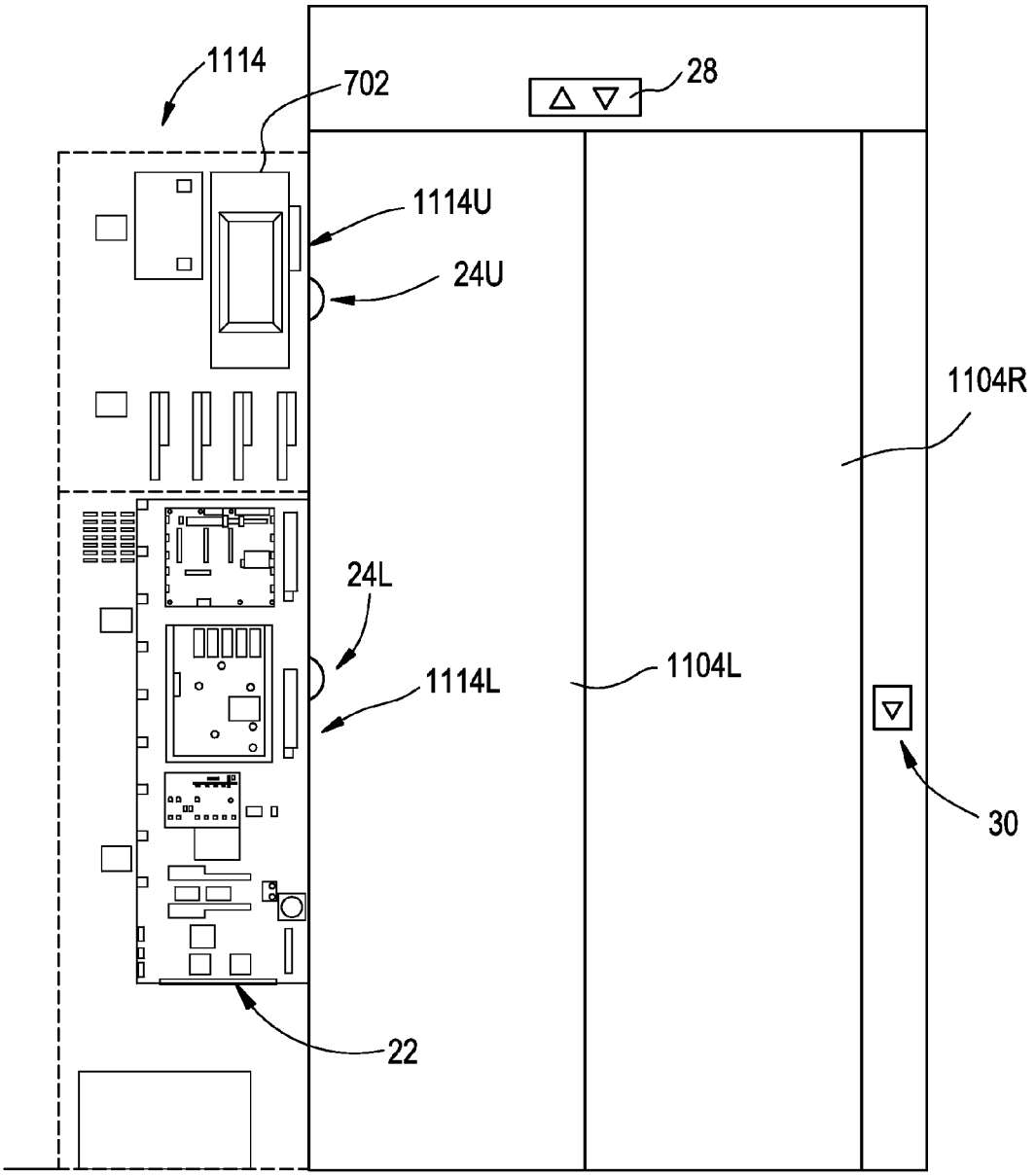
FIG. 6 is yet another front elevational view taken from the landing side of the elevator arrangement.
Figure 7A:
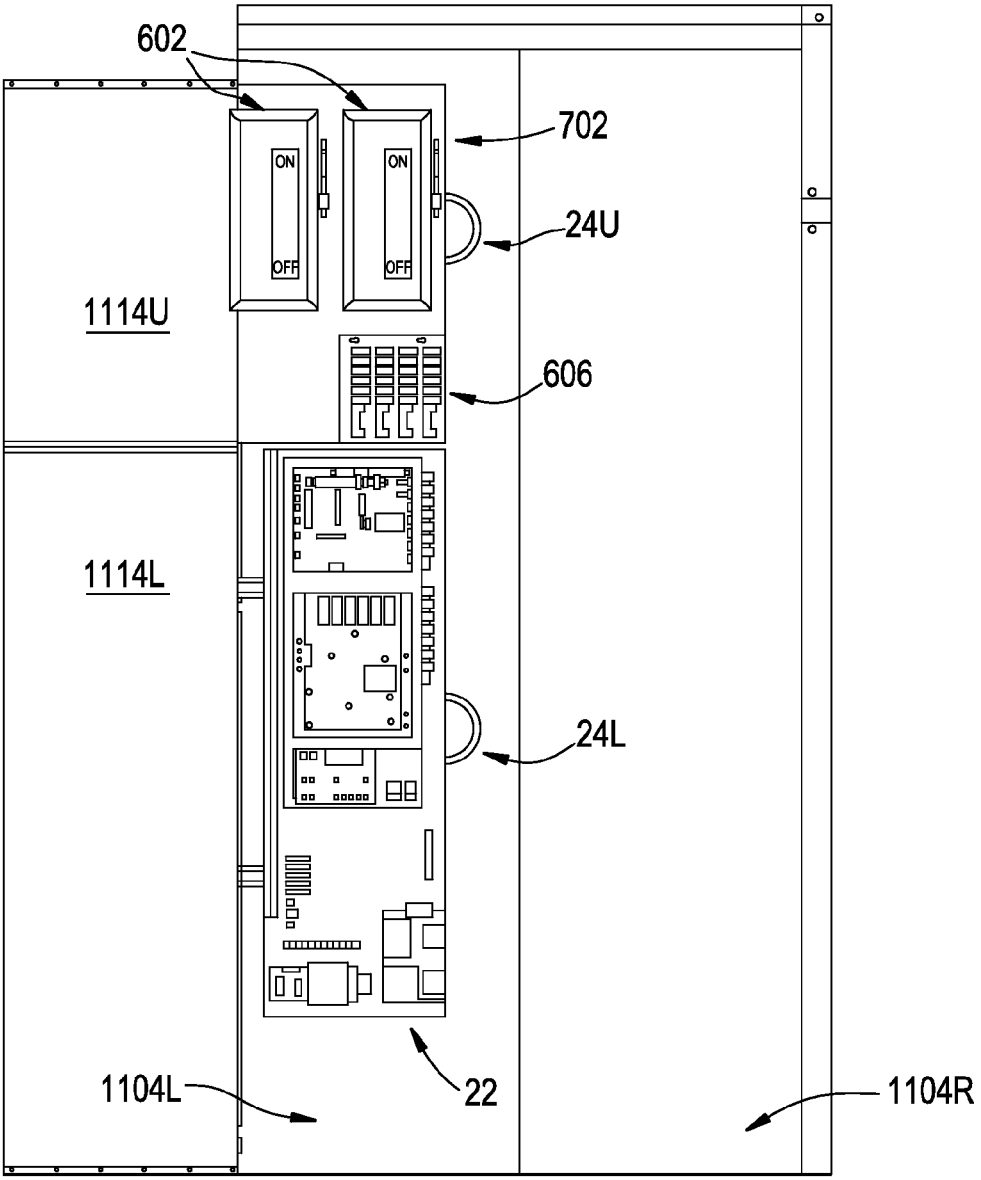
FIG. 7A is still another front elevational view taken from a landing side of the elevator arrangement.

FIG. 6 is another front elevational view taken from the landing side of the elevator arrangement described above with regard to FIGS. 1A through 4. FIG. 7A is yet another front elevational view taken from a landing side of the elevator arrangement described above with regard to FIGS. 1A through 4, and FIG. 7B is a perspective view of the example embodiment shown in FIG. 7A.

In FIG. 6, the portion (e.g., dry-wall) of the landing wall 1113 at the landing side and the landing side portion of the low voltage maintenance cabinet 1114 are omitted for clarity. However, in FIGS. 5A, 5B, 7A and 7B, the landing side portion of the low voltage maintenance cabinet 1114 is shown.

Referring to FIGS. 5A through 7B, the low voltage maintenance cabinet 1114 is arranged within the landing wall 1113. As shown in FIG. 6, the elevator arrangement or system also includes signal devices 28 and call buttons 30, each of which are well-known in the art.

As mentioned above, the low voltage maintenance cabinet 1114 includes an upper cabinet 1114U and a lower cabinet 1114L.

The low voltage maintenance panel 22 is arranged in the lower cabinet 1114L. In more detail, the low voltage maintenance panel 22 (sometimes referred to as the first maintenance panel) is arranged on slide rails within the lower cabinet 1114L. The low voltage maintenance panel 22 includes only electrical components that are serviceable while the elevator is in operation.

A handle 24L is fixed to the low voltage maintenance panel 22. The handle 24L is configured to be used to slide the low voltage maintenance panel 22 in and out of the lower cabinet 1114L (between the open and closed positions). The lower cabinet 1114L also includes a brake release (not shown). The brake release may be manual or electric as discussed in more detail later with regard to FIGS. 8A and 8B.

Still referring to FIGS. 5A through 7B, an auxiliary maintenance panel 702 is arranged in the upper cabinet 1114U. The auxiliary maintenance panel 702 (sometimes referred to as the second maintenance panel) includes at least one extra option board 606 and/or at least one disconnect switch 602. Additionally, a handle 24U is fixed to the auxiliary maintenance panel 702. The handle 24U is configured to be used to slide the auxiliary maintenance panel 702 in and out of the upper cabinet 1114U. The auxiliary maintenance panel 702 will be discussed in more detail later with regard to FIG. 9.

According to at least some example embodiments, the upper and lower cabinets 1114U and 1114L may be separate maintenance cabinets or compartments of the same single maintenance cabinet. In each case, the upper cabinet 1114U and the lower cabinet 1114L are configured to be accessed independently from one another. As discussed above, each of the upper cabinet 1114U and the lower cabinet 1114L may have a separate maintenance cabinet door and lock enclosing a maintenance panel within the cabinet, such that each of the upper and lower cabinets 1114U and 1114L are independently accessible.

Figure 7B:
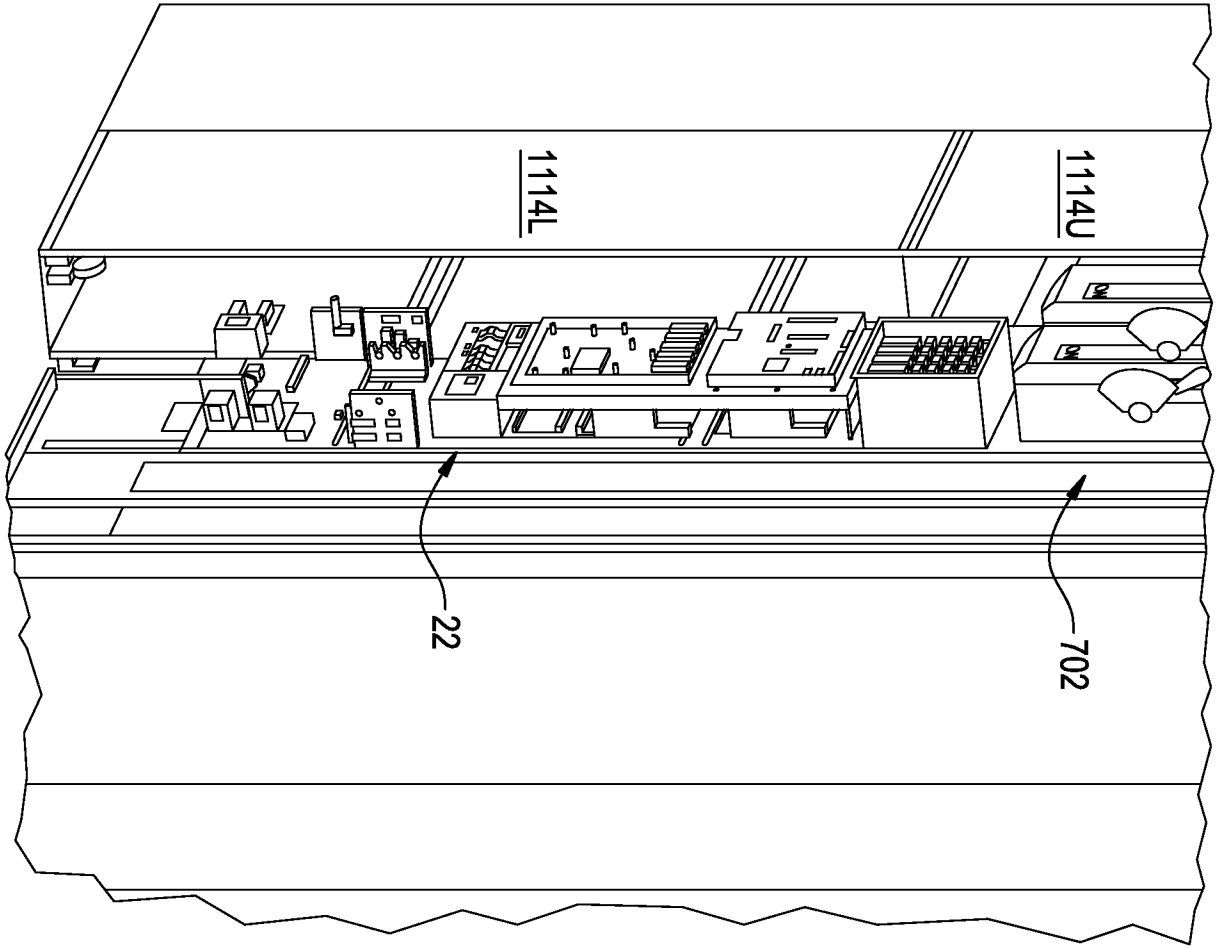
FIG. 7B is a perspective view of the example embodiment shown in FIG. 7A.

Each of FIGS. 7A and 7B shows the low voltage maintenance panel 22 and the auxiliary maintenance panel 702 slid or extended out from the lower cabinet 1114L and the upper cabinet 1114U, respectively. As mentioned above, this may also be referred to as the open or maintenance access position. When in the open position, the low voltage maintenance panel 22 and/or the auxiliary maintenance panel 702 are accessible by a maintenance technician at the elevator landing.

According to at least some example embodiments, the low voltage maintenance cabinet 1114 may be positioned at the top floor of the building in which the elevator system is installed. In another example, the low voltage maintenance cabinet 1114 may be installed at the uppermost floor at which the elevator is accessible.

Figure 8A:
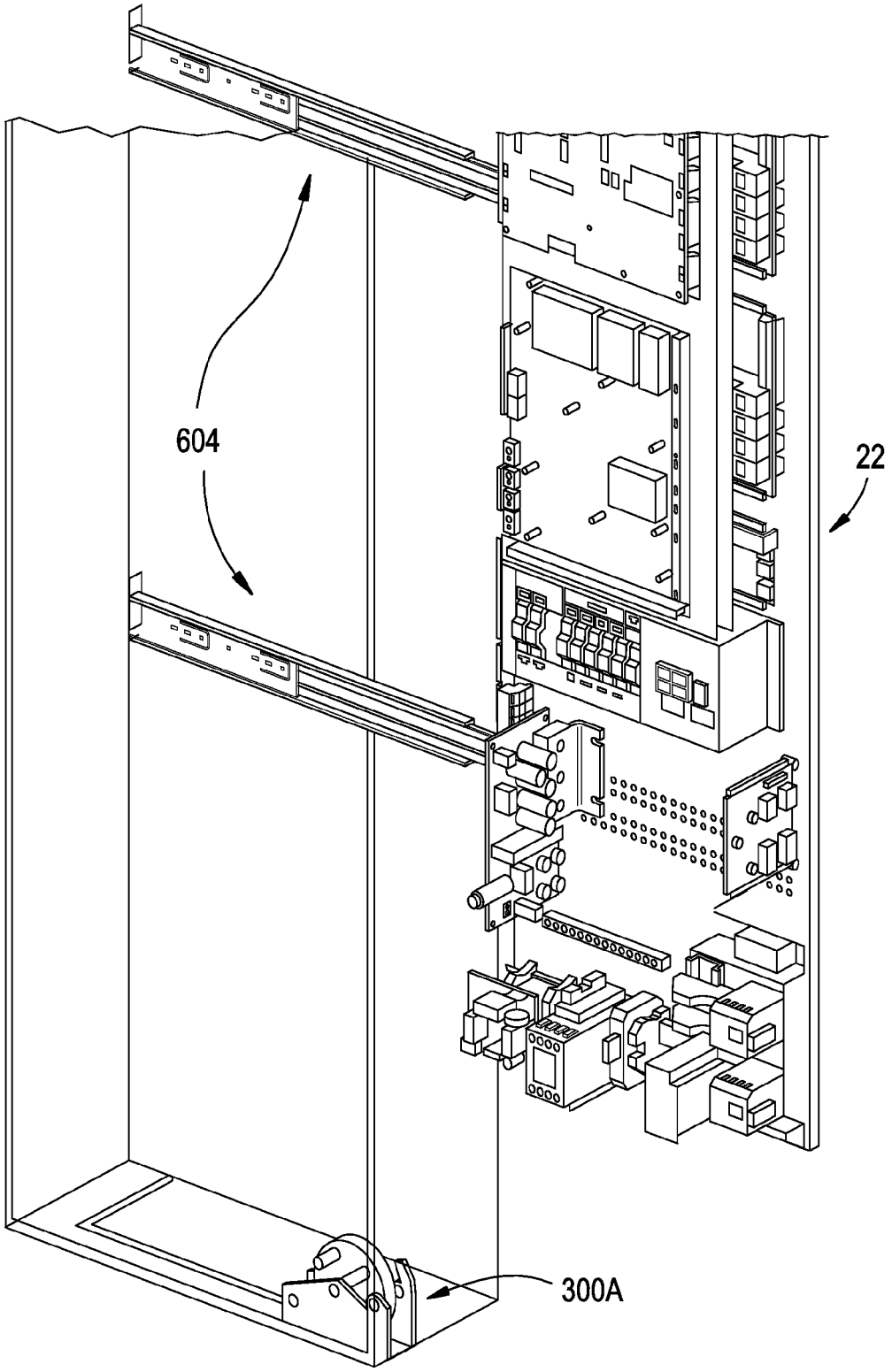
FIG. 8A is a larger perspective view of a portion of an example embodiment of the lower cabinet of the low voltage maintenance cabinet.

FIG. 8A is a larger perspective view of a portion of an example embodiment of the lower cabinet 1114L. In the example embodiment shown in FIG. 8A, the lower cabinet 1114L includes a manual break release 300A in addition to the low voltage maintenance panel 22. In this example embodiment, the manual brake release 300A is arranged below the low voltage maintenance panel 22 at the bottom portion (or bottom) of the lower cabinet 1114L. Because manual brake releases such as the manual brake release 300A shown in FIG. 8A are well known, a detailed description is omitted.

Still referring to FIG. 8A, as mentioned above, the low voltage maintenance panel 22 is fixed to slide rails 604 mounted within the lower cabinet 1114L. In this example, two slide rails 604 are mounted above one another and fixed inside the lower cabinet 1114L. The slide rails 604 enable the low voltage maintenance panel 22 to slide in and out of the lower cabinet 1114L in the manner described herein.

Slide rails 604 may be commercial "total extension rails" measuring about 16 inches long. In this example, each rail includes a base mounting rail and a sliding removable rail. The sliding removable rail may be removed from the base mounting rail using a locking handle. The base mounting rail is attached to the lower cabinet 1114L, and the sliding removable rail is attached to the low voltage maintenance panel 22. The removable nature of the sliding rails 604 allows the service people to remove the maintenance panel 22 from the lower cabinet 1114L when necessary by releasing the locking handle in each rail.

Figure 8B:
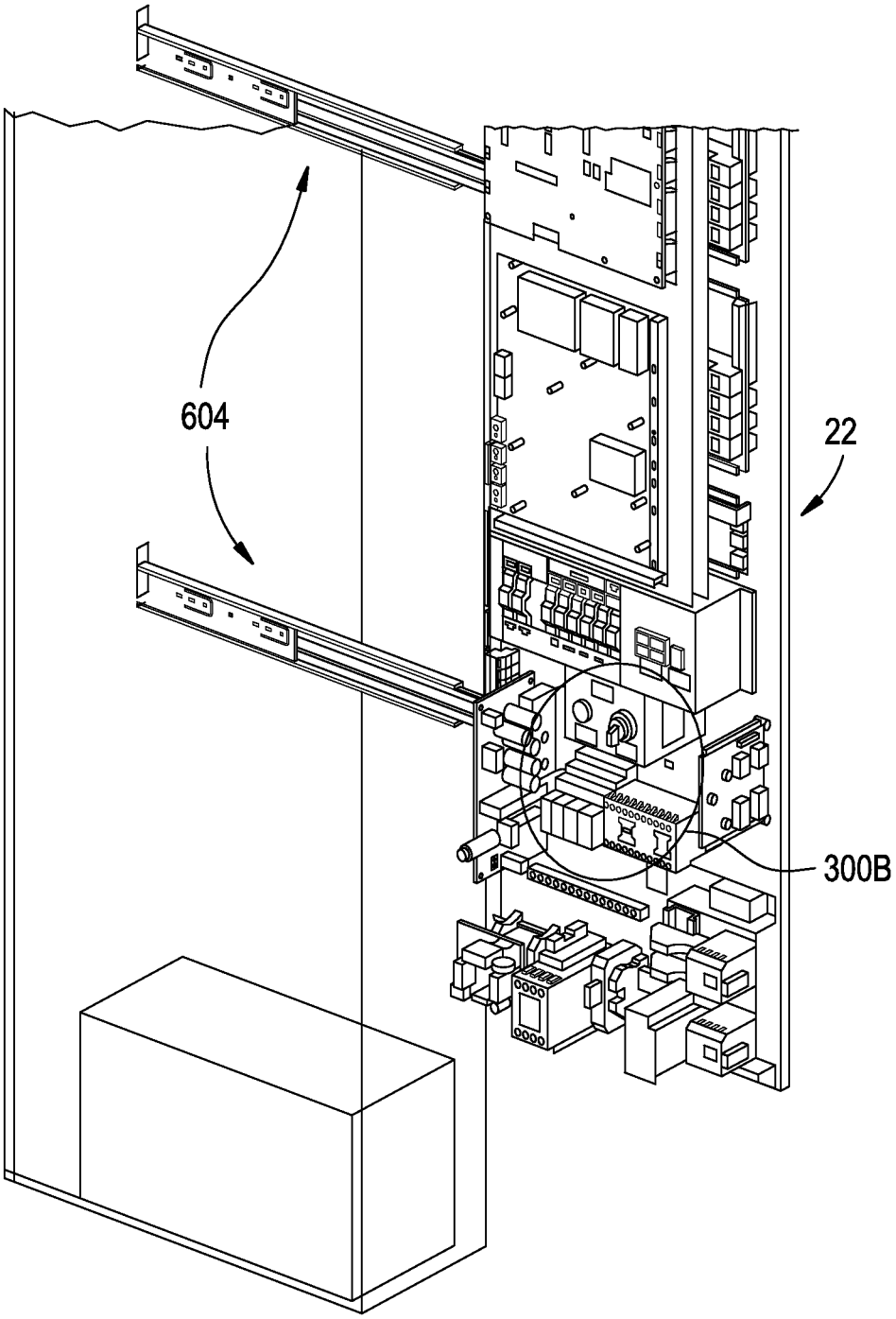
FIG. 8B is another larger perspective view of an example embodiment of the lower cabinet of the low voltage maintenance cabinet.

FIG. 8B is another larger perspective view of an example embodiment of the lower cabinet 1114L. The example embodiment shown in FIG. 8B is similar to the example embodiment shown in FIG. 8A, except that the lower cabinet 1114L shown in FIG. 8B includes an electric break release 300B, rather than the manual brake release 300A as in FIG. 8A. The electric brake release 300B may be an arrangement of relays, switches and a display. The electric brake release 300B may also include an uninterrupted power supply (UPS) so that the electric brake release 300B functions in the event of a power outage at the elevator installation. Because electric brake releases such as the electric brake release 300B shown in FIG. 8B are well known, a detailed description is omitted.

Figure 9:
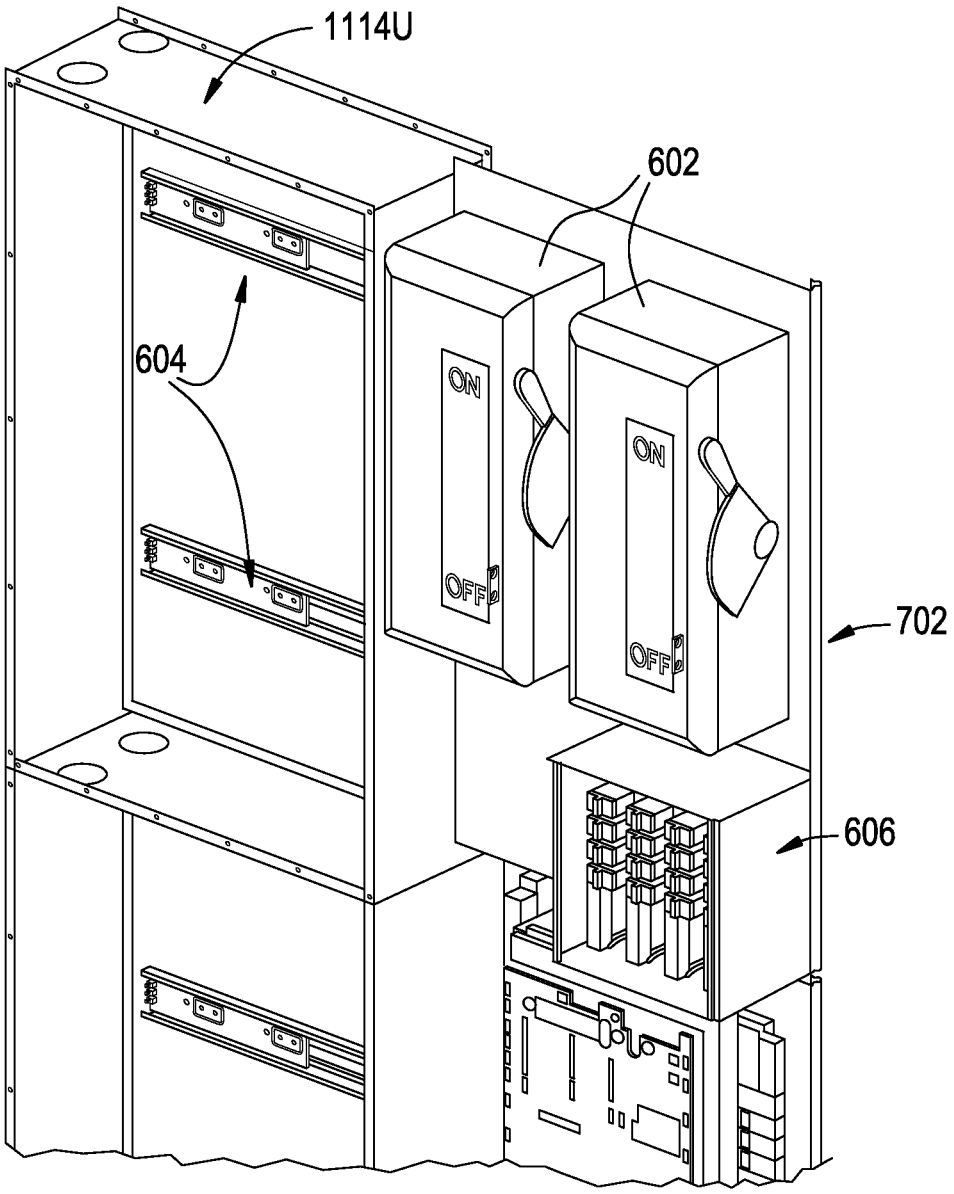
FIG. 9 is a larger perspective view of an example embodiment of the upper cabinet of the low voltage maintenance cabinet.

FIG. 9 is a larger perspective view of an example embodiment of the upper cabinet 1114U.

Referring to FIG. 9, the upper cabinet 1114U includes an auxiliary maintenance panel 702. The auxiliary maintenance panel 702 is mounted to slide rails 604 such that the auxiliary maintenance panel 702 slides in and out of the upper cabinet 1114U in the manner described herein. In this example embodiment, the slide rails 604 shown in FIG. 9 are the same or substantially the same as those shown in FIGS. 8A and 8B.

As mentioned above, the auxiliary maintenance panel 702 includes at least one disconnect switch 602 and at least one extra option board 606, each of which is well-known in the art.

According to at least some example embodiments, the low voltage maintenance panel 22 and the auxiliary maintenance panel 702 may be slid out from the low voltage maintenance cabinet 1114 individually and/or independently, such that one of the maintenance panels 22 and 702 remains within the low voltage maintenance cabinet 1114 while the other is slid out.

Figure 10:
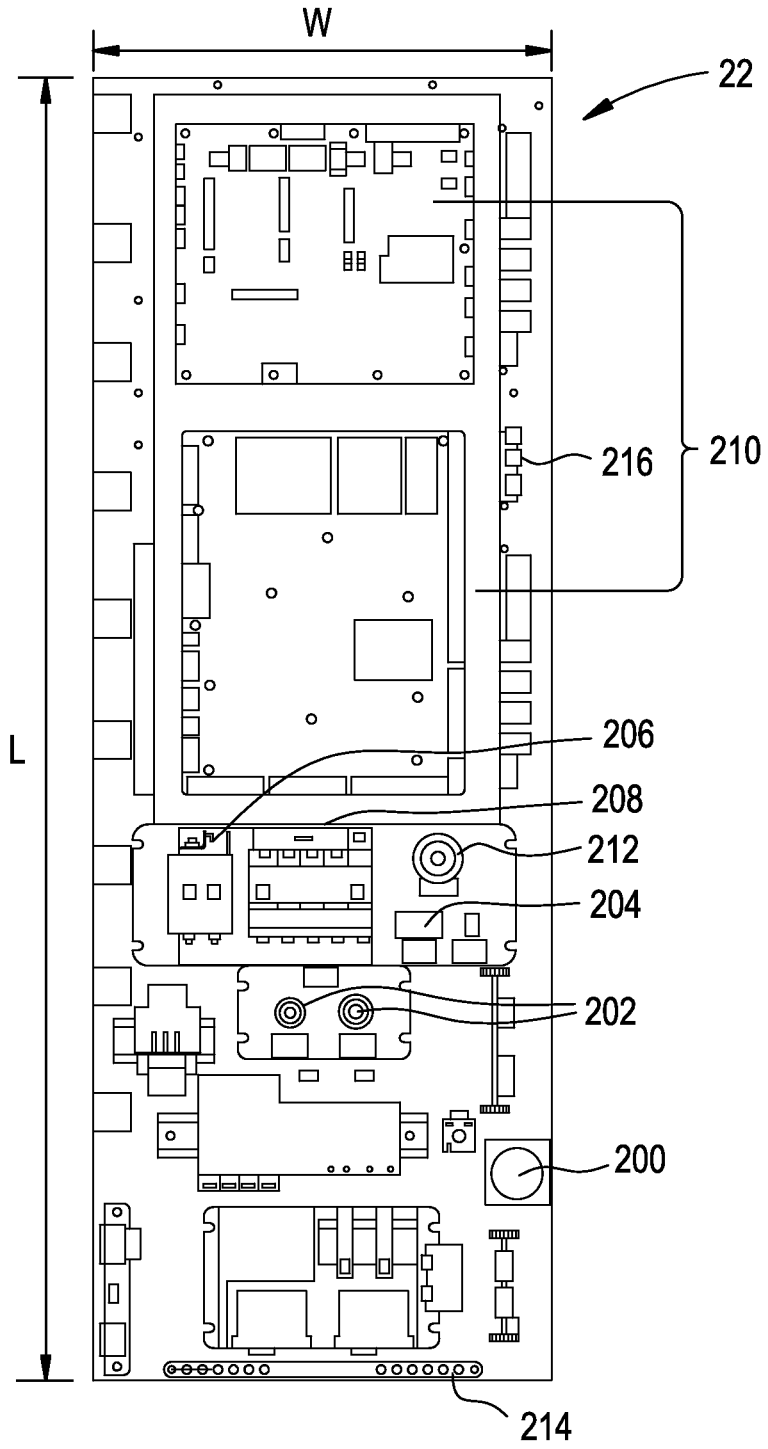
FIG. 10 is a plan view of a low voltage maintenance panel according to an example embodiment.

FIG. 10 is a plan view of an example embodiment of the low voltage maintenance panel 22.

According to at least some example embodiments, the low voltage maintenance panel 22 includes elevator components that can be serviced while the elevator is in operation. The low voltage maintenance panel 22 does not include high voltage components that require the elevator to be shut-off or shutdown prior to being accessed for maintenance. In this regard, the low voltage maintenance panel 22 includes only elevator components that are serviceable while the elevator is in operation.

As discussed herein, an elevator in operation refers to an elevator with the system energized, whereas an elevator that is shut down refers to a de-energized system.

In more detail with regard to FIG. 10, the low voltage maintenance panel 22 includes, for example: a stop switch 200; brake release switches 202; a display 204; car and hoistway door bypass switches 206; inspection operating devices 208; car-safety mechanism circuits 210; a manual reset switch 212; an earth bar 214; and a seismic reset switch 216. Each of these components is generally well-known, and thus, only a brief discussion is provided below.

The stop switch 200 is used to shut down the elevator when activated (closed). When the elevator is operating normally, the stop switch 200 is deactivated (open).

The brake release switches 202 release the brakes of the hoisting machine 1106 for inspection tests and evacuation. The brake release switches 202 are used with an electric brake release.

The display 204 displays elevator car speed, elevator car direction, and a landing zone for the elevator.

The car and hoistway door bypass switches 206 change the operation of the elevator and the doors from normal operation to inspection operation. When in normal operation, the elevator runs according to the building configuration by attending to all the tasks that the elevator is requested to do through the landing call buttons and the car control panel. When in inspection operation, the elevator can be controlled through the inspection operating devices.

Inspection operating devices 208 allow the service people to control the elevator when the elevator is in inspection mode.

The car-safety mechanism circuits 210 are the main boards for controlling all electrical parts of the elevator. The car-safety mechanism circuits 210 may include a central processing unit (CPU) to manage logic tasks required by the elevator, and an advance door opening board (ADON) to manage the electrical safety functions of the elevator.

The traction loss reset switch 212 resets the motor to the original angular position between the rotor and the stator after the angle changes with usage over time causing traction loss.

The earth bar 214 grounds the components on the low voltage maintenance panel 22.

The seismic reset switch (also referred to as an earthquake board) 216 detects and reacts to seismic disturbances, such as earthquakes. In one example, the seismic reset switch 216 resets the elevator after the elevator is shut down because of, for example, an earthquake.

The low voltage maintenance panel 22 may also include a fuse state identification module, a VTC board, gateway boards, ETSL boards, and I/O optional boards.

The fuse state identification module identifies the state of the fuses of the rectifier (REC) board. The REC board is located with the high voltage components in the hoistway.

The VTC board detects weight in the car and reacts based on the detected weight. A sensor placed in the elevator car sends a signal with weight information to the VTC board. The VTC board amplifies and outputs the signal to the elevator drive as a parameter to correct control of the elevator.

The gateway boards are used to group elevators. In group configurations, communication between control cabinets within each group. Each control cabinet includes at least one gateway board, which is used as the communication interface between the control cabinets of each elevator. A battery is optional and used to feed the voltage of the gateway boards when needed.

In high-speed elevators, ETSL boards suppress and/or prevent the possibility of the car running into the buffer at an excessive speed. An ETSL board detects when the elevator is running above a given, desired or predetermined speed limit and instructs the elevator to slow down.

The I/O optional boards connect different control options. The I/O optional boards can receive signals, and control external devices.

Input optional boards, a safety chain module and/or a battery may also be included in the maintenance panel 22. The input optional boards are extra optional boards, which are configured to (e.g., only to) receive signals. The safety chain module is used to decrease the voltage of the safety chain circuit.

An I/O optional board is used to connect different control options, such as: fireman switch at landings, fire detection, emergency power drive signal, earthquake board, etc. The I/O optional board serves as an interface for the existing shaft wiring, the landing calls and their LED's, lamps, gongs, lanterns direction arrow, etc.

The maintenance panel 22 may also include a repeater to amplify the signal for the fire status panel (by a contractor).

In the example embodiment shown in FIG. 10, the low voltage maintenance panel 22 may be about 1.2 meter long by about 0.35 meters wide by about 0.15 meters deep. In other words, the dimensions (L×W×D) may be about 1.2 m by about 0.35 m by about 0.15 m. However, example embodiments are not limited to these dimensions. When installed, the low voltage maintenance panel 22 may be arranged such that the longer (e.g., 1 m) sides of the low voltage maintenance panel 22 are arranged vertically.

As mentioned above with regard to FIG. 1A, the elevator arrangement includes a high voltage maintenance cabinet 1112 arranged in the elevator shaft. In the example shown in FIG. 1A, the high voltage maintenance cabinet 1112 is mounted to the hoistway wall 1115A in the upper portion of the elevator shaft.

Figure 11B:
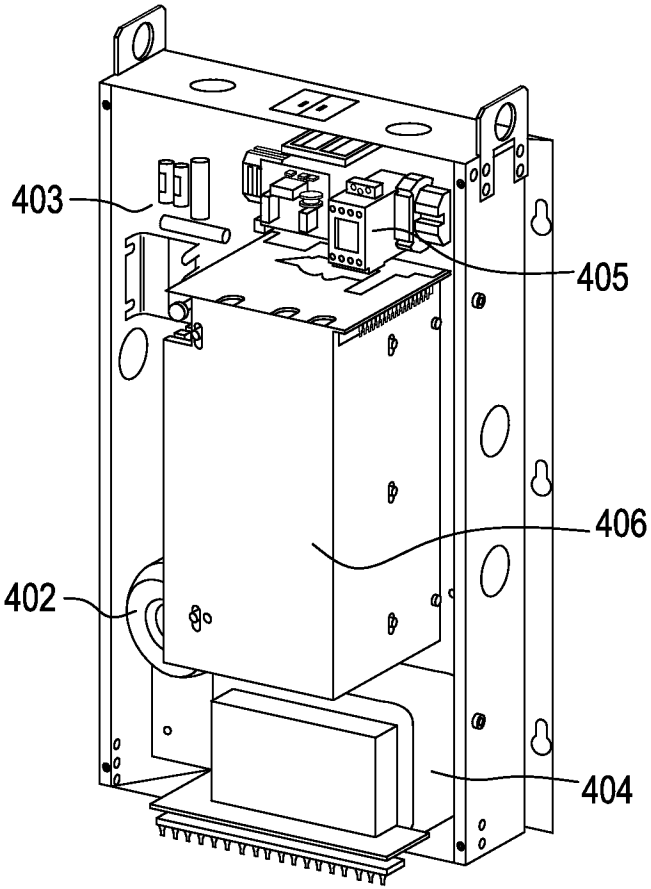
FIG. 11B is a perspective view of the high voltage maintenance cabinet shown in FIG. 11A.
Figure 11A:
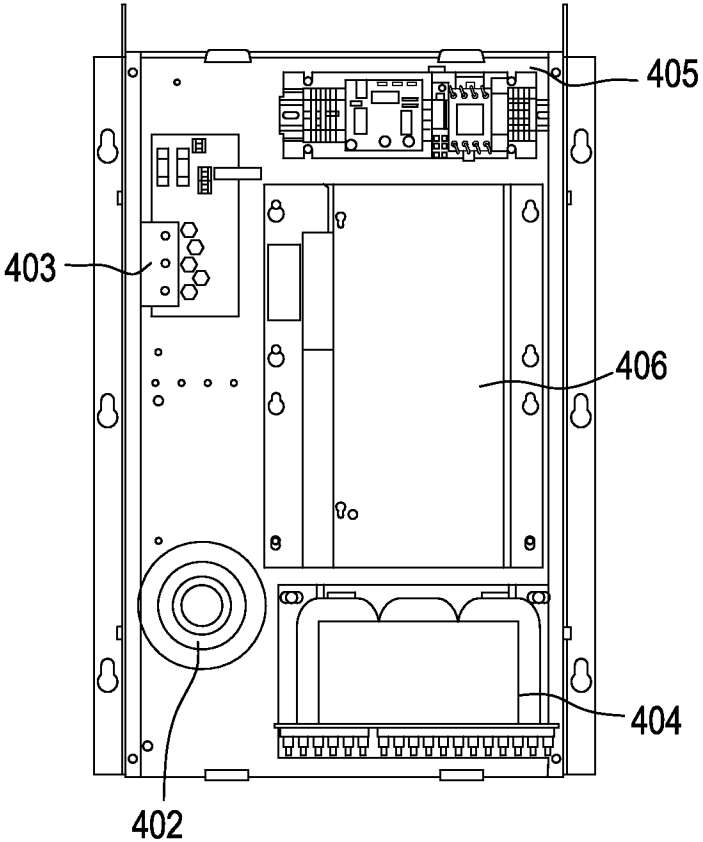
FIG. 11A is a front view of a high voltage maintenance cabinet according to an example embodiment.

FIG. 11A is a front view of an example embodiment of the high voltage maintenance cabinet 1112. FIG. 11B is a perspective view of the high voltage maintenance cabinet 1112 shown in FIG. 11A.

Referring to FIGS. 11A and 11B, the high voltage maintenance cabinet 1112 includes high voltage electrical components of the elevator. In one example, the high voltage components of the elevator include an elevator drive system 406, an autotransformer 404, and a toroid 402. The high voltage maintenance cabinet 1112 may also include a REC board 403 and an emergency brake circuit 405.

In FIGS. 11A and 11B, the elevator drive system 406 is shown as included within the high voltage maintenance cabinet 1112. However, in other example embodiments the elevator drive system 406 may be separate from the high voltage maintenance cabinet 1112. In at least this example embodiment, the elevator drive system 406 is still located within the hoistway, but mounted separately to the hoistway wall and/or car frame.

As is known, the elevator drive system 406 controls the elevator according to information from the CPU and ADON boards. The autotransformer 404 is configured to receive the building voltage, and to manage the building voltage according to the required voltage for elevator systems. The toroid 402 transforms the voltage from the autotransformer 404 to 220V AC and/or 110V AC required for some electric circuits, and removes, from the voltage signals, possible harmonics of the autotransformer 404 that may cause the control system to malfunction.

In the example embodiment shown in FIGS. 11A and 11B, the autotransformer 404 is included in the high voltage maintenance cabinet 1112. In alternative example embodiments, however, the autotransformer 404 may be placed in another cabinet within the elevator system. In this example, the autotransformer 404 is omitted from the high voltage maintenance cabinet 1112 shown in FIGS. 11A and 11B.

Figure 12:
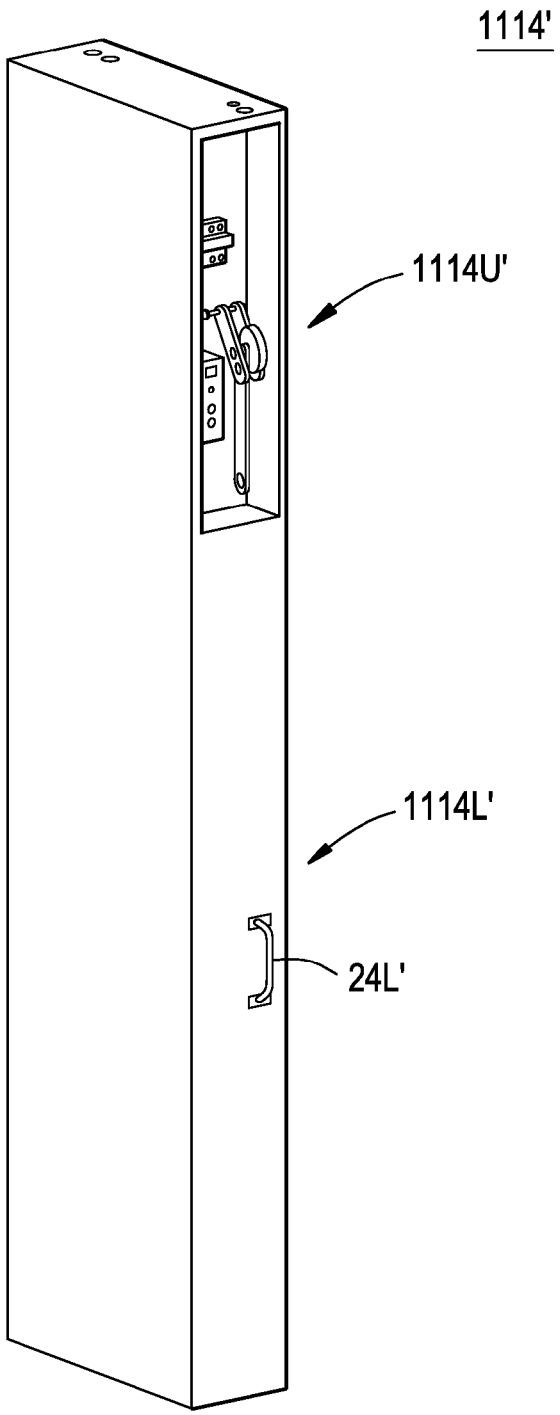
FIGS. 12 and 13 are perspective views of a low voltage maintenance cabinet according to another example embodiment.
Figure 13:
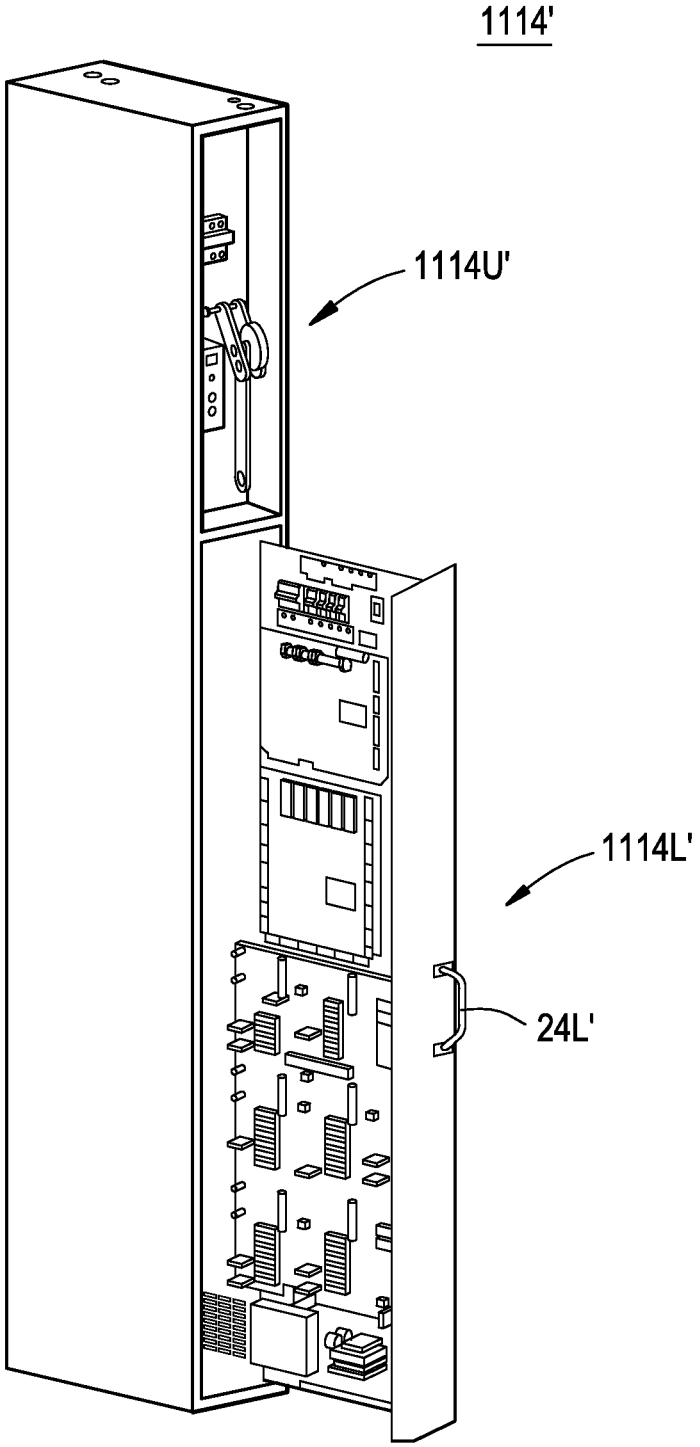

FIGS. 12 and 13 are perspective views of a low voltage maintenance cabinet according to another example embodiment. FIG. 12 shows the low voltage maintenance cabinet with the lower portion closed, whereas FIG. 13 shows the low voltage maintenance cabinet with the lower portion open.

The low voltage maintenance cabinet shown in FIGS. 12 and 13 and described in more detail below may be included in the elevator system described above with regard to FIGS. 1-11B. In one example, the low voltage maintenance panel shown in FIGS. 12 and 13 may replace the low voltage maintenance cabinet 1114 described above.

Referring to FIGS. 12 and 13, in this example embodiment, the low voltage maintenance cabinet 1114' includes an upper portion 1114U' and a lower portion 1114L'. Unlike the upper cabinet 1114U described above, the upper portion 1114U' is fixed in that the components do not slide in and out of the low voltage maintenance cabinet 1114'. In this regard, the upper portion 1114U' does not include a maintenance panel configured to slide in and out of the low voltage maintenance cabinet 1114'.

Figure 14B:
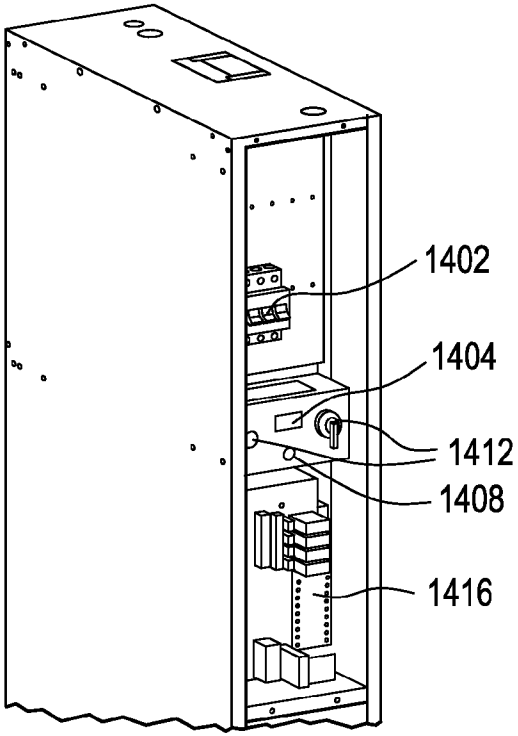
FIGS. 14A and 14B are enlarged views of the upper portion 1114U' shown in FIGS. 12 and 13.
Figure 14A:
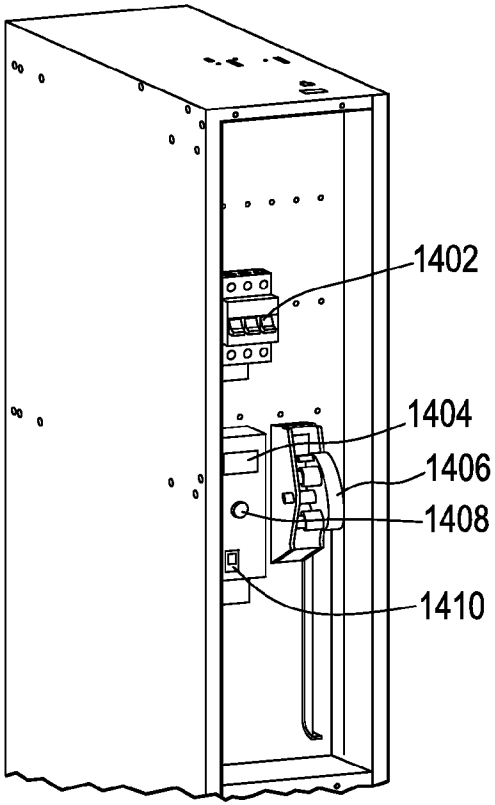

FIGS. 14A and 14B are enlarged views of the upper portion 1114U' shown in FIGS. 12 and 13. FIG. 14A shows an example embodiment including a manual brake release, whereas FIG. 14B shows an example embodiment including an electric brake release.

Referring to FIG. 14A, the upper portion 1114U' includes encapsulated disconnect switches 1402, a display 1404, a manual brake release 1406, an LED light 1408, and a switch 1410.

The manual brake release 1406 is the same as the manual brake release 300A discussed above with regard to FIG. 8A, and thus, a detailed description will be omitted for the sake of brevity.

The display 1404 shows the velocity and direction of the elevator motor when the manual elevator brake is activated. Alternatively, the display 1404 may indicate elevator car speed, elevator car direction, and a landing zone for the elevator as discussed above with regard to display 204. The LED light 1408 indicates when the elevator car is in a door zone. The switch 1410 is configured to turn the display 1404 and the LED light 1408 on and off.

The encapsulated disconnect switches 1402 may be circuit breakers, load break switches, etc. According to example embodiments, the encapsulated disconnect switches 1402 are configured to disconnect the elevator motor from the power supply as is well known in the art.

Referring to FIG. 14B, in this example embodiment the upper portion 1114U' includes the encapsulated disconnect switches 1402, the display 1404, and the LED light 1408 discussed above with regard to the example embodiment shown in FIG. 14A. The example embodiment of the upper portion 1114U' shown in FIG. 14B further includes electric brake release switches 1412, and electric brake release 1414.

The electric brake release switches 1412 are the same as the electric brake release switches 202 discussed above with regard to FIG. 10. The electric brake release 1414 is the same (at least functionally) as the electric brake release 300B shown in FIG. 8B. The electric brake release 1414 may be an arrangement including relays 1416, the switches 1412, the display 1404 and the UPS. Because these components are generally well-known, a detailed discussion is omitted.

Returning to FIGS. 12 and 13, as mentioned above the low voltage maintenance cabinet 1114' also includes a lower portion 1114L'. The lower portion 1114L' includes a maintenance panel 22'. Similar to the maintenance panel 22 discussed above, the low voltage maintenance panel 22' is arranged on slide rails (not shown) within the lower portion 1114L' of the low voltage maintenance cabinet 1114'. A handle 24L is fixed to the door of the lower portion 1114L' of the low voltage maintenance cabinet 1114'. The handle 24L' is configured to be used to open the lower portion 1114L' and slide the low voltage maintenance panel 22' in and out of the lower portion 1114L' (between the open and closed positions). The slide rails are the same as the slide rails 604 discussed above with regard to FIGS. 8A and 8B.

Figure 15:
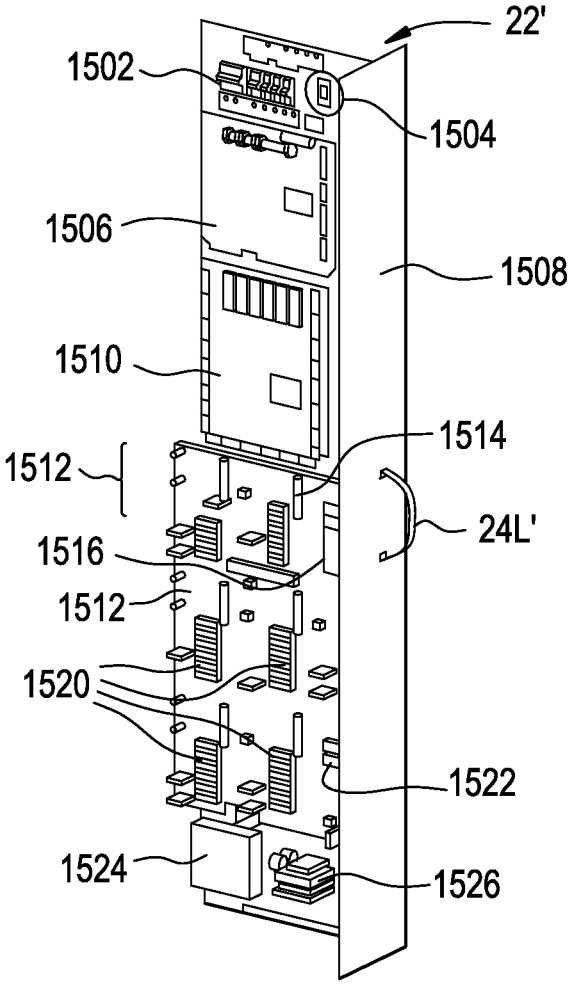
FIG. 15 illustrates a low voltage maintenance panel according to another example embodiment.

FIG. 15 illustrates an example embodiment of the maintenance panel 22' in more detail.

Referring to FIG. 15, the maintenance panel 22' includes a switch module bypass 1502 and a traction loss switch 1504 arranged in the upper part of the low voltage maintenance panel 22'. The traction loss switch 1504 is the same as that described above with regard to the maintenance panel 22.

The switch module bypass 1502 includes the car and door bypass switches 206 discussed above.

The low voltage maintenance panel 22' also includes a CPU 1506 and ADON circuit 1510. The CPU 1506 and the ADON circuit 1510 are the same as those discussed above with regard to the maintenance panel 22.

The maintenance panel 22' also includes a VTC board 1514, gateway boards 1516, ETSL boards 1522, and/or I/O optional boards 1512, 1520.

As discussed above, the VTC board 1514 detects weight of passengers in the elevator car and reacts based on the detected weight. A sensor in the elevator car sends a signal with weight information to the VTC board 1514. The VTC board 1514 amplifies and sends the received signal to the elevator drive system as a parameter to correct control of the elevator machine.

The gateway boards 1516 are used to group elevators. In group configurations, communication between control cabinets within each group. Each control cabinet includes at least one gateway board 1516, which is used as the communication interface between the control cabinets of each elevator. A battery is optional and used to feed the voltage of the gateway boards when needed.

In high-speed elevators, the ETSL boards 1522 suppress and/or prevent the possibility of the car running into the buffer at an excessive speed. The ETSL board 1522 detects when the elevator is running above a given, desired or predetermined speed limit and instructs the elevator to slow down.

The I/O optional boards 1512 connect different control options. The I/O optional boards 1512 may receive signals, and control external devices. As discussed above, the I/O optional board 1512 is used to connect different control options, such as: fireman switches at landings, fire detection, emergency power drive signal, earthquake board, etc. The I/O optional board serves as an interface for the existing shaft wiring, the landing calls and their LED's, lamps, gongs, lanterns direction arrow, etc.

Optional boards 1520, a safety chain module 1526 and/or a battery 1524 may also be included in the low voltage maintenance panel 22'. The optional boards 1520 are extra optional boards, which are configured to send and receive signals.

The safety chain module 1526 is used to decrease the voltage of the safety chain circuit. The battery 1524 is optional and used to feed the voltage of the gateway boards 1516 if required. In one example, the battery 1524 may be a 24V DC battery.

Although the example embodiment shown in FIG. 15 includes the safety chain module 1526 and battery 1524, these components may be omitted and relocated in the hoistway along with other hoistway elevator components.

The low voltage maintenance panel 22' may also include a repeater to amplify the signal for the fire status panel (by a contractor).

Figure 16:
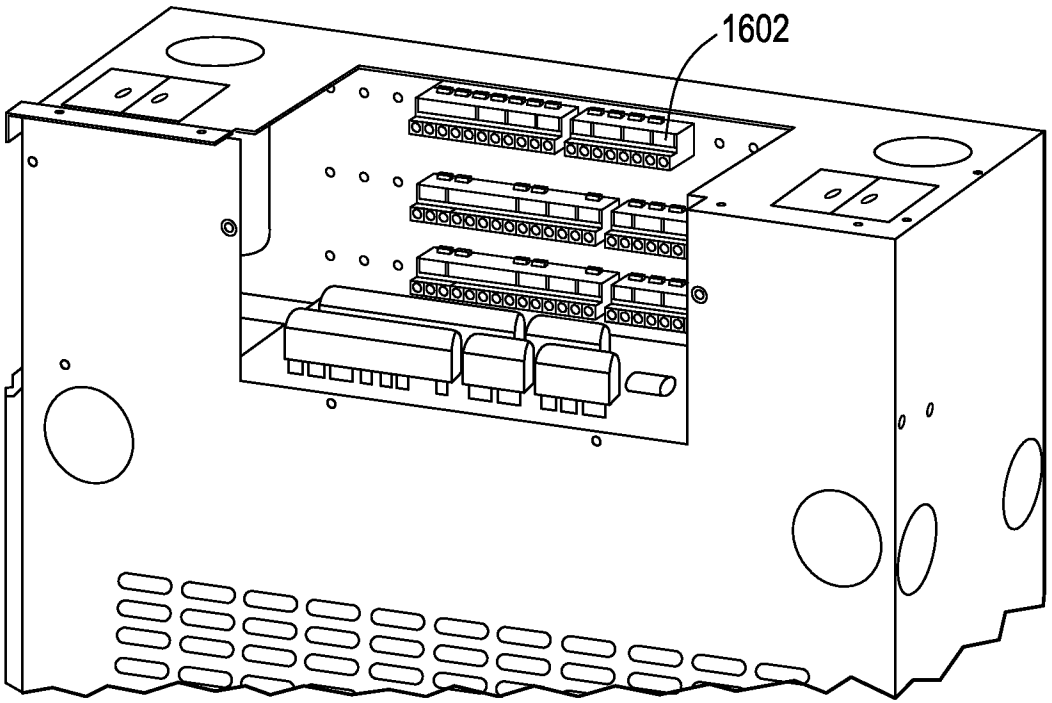
FIG. 16 illustrates an example embodiment of terminal blocks access for fast connections between components of the low voltage maintenance panel and components in the hoistway.

FIG. 16 illustrates an example embodiment of terminal blocks access for fast connections between components of the low voltage maintenance panel (e.g., CPU, ADON board, Optional boards, etc.) and components in the hoistway (e.g., traveling cable, shaft bundle and components of first maintenance cabinet 1112).

Referring to FIG. 16, the terminal blocks access 1602 is located at the back panel of the maintenance cabinet with access from the hoistway side. The terminal blocks access includes a cover plate for preventing entry of dust and/or water, and/or avoiding exposed connections in the hoistway.

Figure 17:
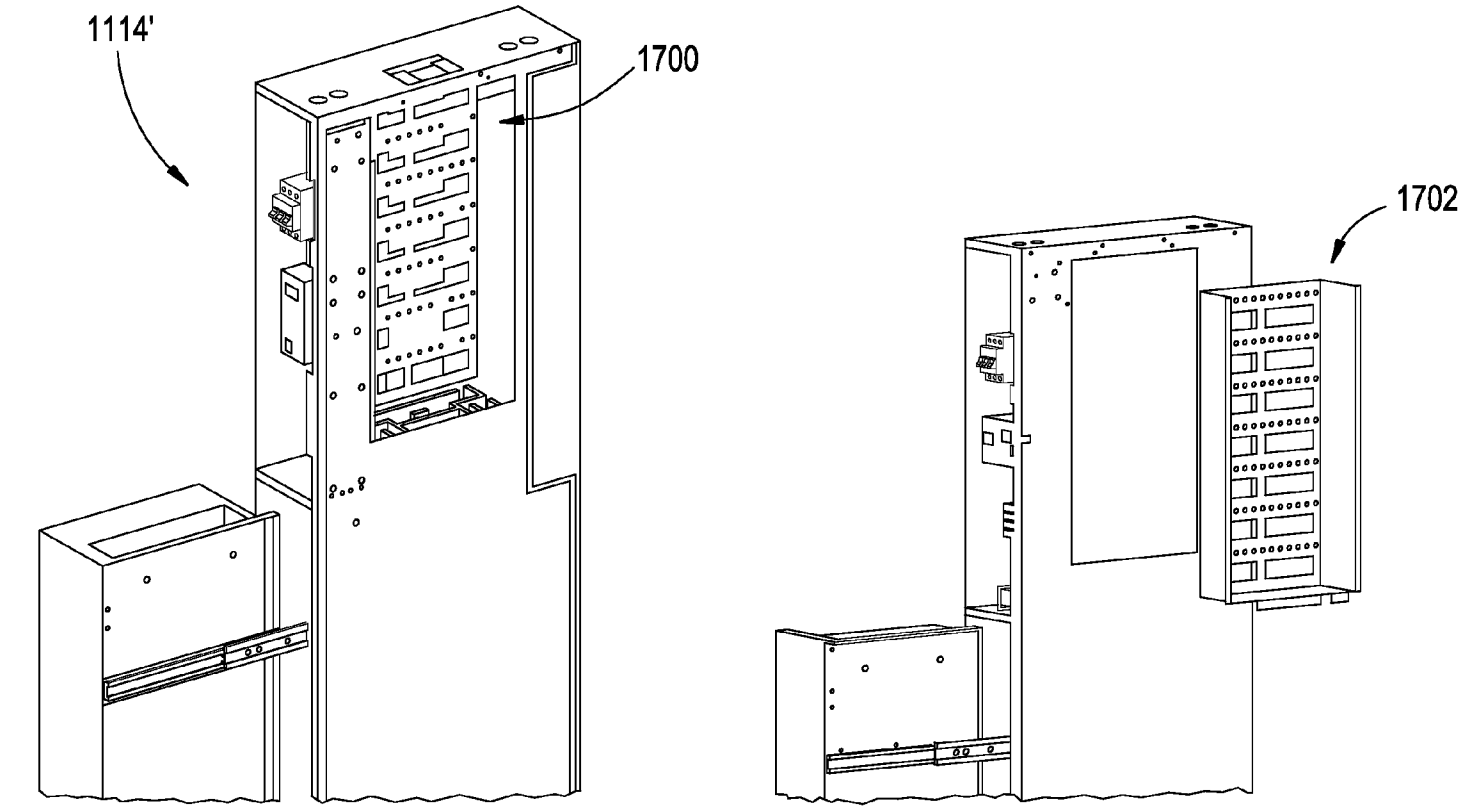
FIG. 17 illustrates another example embodiment of terminal blocks access for fast connections between components of the low voltage maintenance panel and components in the hoistway.

FIG. 17 illustrates another example embodiment of terminal blocks access for fast connections between components of the low voltage maintenance panel and components in the hoistway.

Referring to FIG. 17, the terminal blocks access 1700 includes a removable box 1702 for service. The terminal blocks access shown in FIG. 17 is located at the back panel of the maintenance cabinet 1114' with access from the hoistway side. The terminal blocks access 1700 includes a cover plate for preventing entry of dust and/or water, and/or avoiding exposed connections in the hoistway.

As discussed herein, low voltage maintenance cabinets according to at least some example embodiments may include a door enclosing one or more low voltage maintenance panels within the low voltage maintenance cabinet. According to at least some example embodiments, the door may be arranged on hinges at one side of the door so as to swing open. Alternatively, the door may be arranged so as to slide out along with the low voltage maintenance panel.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An elevator arrangement for an elevator, the elevator arrangement comprising:

a hoisting machine in an elevator hoistway, the hoisting machine being configured to move an elevator car within the elevator hoistway via a hoisting rope arrangement;

a first maintenance cabinet within the elevator hoistway, the first maintenance cabinet including components, each of the components included in the first maintenance cabinet being accessible and serviceable only after the elevator is shutdown; and a second maintenance cabinet within a landing wall of the elevator hoistway, the second maintenance cabinet including a maintenance panel, which further includes electrical components, wherein the second maintenance cabinet and the maintenance panel are outside the elevator hoistway;

wherein the maintenance panel is accessible while the elevator is in operation;

wherein the maintenance panel is configured to slide out from the landing wall into a landing doorway of the elevator arrangement in a direction substantially parallel to a sliding direction of elevator doors of the elevator, the maintenance panel being arranged such that the electrical components face outward from the elevator doors toward a landing side of the elevator arrangement;

wherein the maintenance panel is configured to slide entirely within the landing wall in a direction substantially parallel to the landing wall and the sliding direction of the elevator doors;

wherein each of the electrical components included in the maintenance panel are accessible and serviceable while the elevator is in operation;

wherein the second maintenance cabinet further includes an upper cabinet having an upper cabinet door, and a lower cabinet having a lower cabinet door;

wherein the maintenance panel is arranged in the lower cabinet;

wherein the upper cabinet is accessible only through the upper cabinet door from among the upper cabinet door and the lower cabinet door;

wherein the lower cabinet is accessible only through the lower cabinet door from among the upper cabinet door and the lower cabinet door; and wherein the upper and lower cabinets are accessible separately and independently from one another.

2. The elevator arrangement of claim 1, wherein the maintenance panel is accessible from a landing of the elevator.

3. The elevator arrangement of claim 1, further comprising:

a brake release in the second maintenance cabinet.

4. The elevator arrangement of claim 3, wherein the brake release is one of a manual brake release and an electric brake release.

5. The elevator arrangement of claim 1, wherein the second maintenance cabinet is arranged entirely within the landing wall.

6. The elevator arrangement of claim 1, wherein the first maintenance cabinet includes high voltage components of the elevator.

7. The elevator arrangement of claim 6, wherein the high voltage components include at least one of an elevator drive system, an autotransformer, a rectifier board, an emergency brake circuit and a toroid.

8. The elevator arrangement of claim 1, wherein the first maintenance cabinet is fixed in an upper portion of a hoistway wall of the elevator hoistway.

9. The elevator arrangement of claim 1, wherein the upper cabinet includes disconnect switches, a display, a brake release, and an LED indicator light.

10. The elevator arrangement of claim 9, wherein the disconnect switches, the display, the brake release, and the LED indicator light are immovably fixed in the upper cabinet.

11. The elevator arrangement of claim 1, wherein the electrical components include at least one of, a switch module bypass, a traction loss switch, a central processing unit, an advance door opening board circuit, a voltage to current board, gateway boards, emergency terminal speed limiting boards, and input/output boards.

12. The elevator arrangement of claim 11, wherein the maintenance panel further includes at least one of, optional boards and a repeater.

13. The elevator arrangement of claim 1, wherein each of the upper cabinet and lower cabinet are accessible while the elevator is in service.

14. The elevator arrangement of claim 1, wherein the second maintenance cabinet further comprises:

slide rails mounted inside the second maintenance cabinet, the maintenance panel being fixed to the slide rails inside the second maintenance cabinet, wherein the slide rails are configured such that the maintenance panel slides laterally outward from the landing wall in a plane parallel to a plane of the landing wall.

15. The elevator arrangement of claim 1, wherein the maintenance panel is configured to be manually slid out from the landing wall using a handle.

16. The elevator arrangement of claim 1, wherein the electrical components include all electrical components of the elevator that are accessible and serviceable while the elevator is in service.

17. The elevator arrangement of claim 1, wherein the maintenance panel is configured to slide out from the lower cabinet into the landing doorway on the landing side in front of the elevator doors of the elevator.

18. An elevator arrangement for an elevator, the elevator arrangement comprising:

a hoisting machine in an elevator hoistway, the hoisting machine being configured to move an elevator car within the elevator hoistway via a hoisting rope arrangement; and a maintenance cabinet including a maintenance panel, the maintenance panel including components for at least one of control and service of at least one operation of the elevator arrangement, the maintenance panel being configured to slide out from a landing wall into a landing doorway of the elevator arrangement in a direction substantially parallel to a sliding direction of elevator doors of the elevator;

wherein the maintenance panel is arranged such that the components face outward from the elevator doors toward a landing side of the elevator arrangement, wherein the maintenance panel is configured to slide into the landing wall in a direction substantially parallel with the landing wall and the sliding direction of the elevator doors;

wherein when positioned within the landing wall, the maintenance panel is inside the maintenance cabinet and outside of the elevator hoistway;

wherein the maintenance cabinet further includes an upper cabinet having an upper cabinet door, and a lower cabinet having a lower cabinet door;

wherein the maintenance panel is arranged in the lower cabinet;

wherein the upper cabinet is accessible only through the upper cabinet door from among the upper cabinet door and the lower cabinet door;

wherein the lower cabinet is accessible only through the lower cabinet door from among the upper cabinet door and the lower cabinet door; and wherein the upper and lower cabinets are accessible separately and independently from one another.

* * * * *